US012773005B2

(12) United States Patent
Renaud et al.

(10) Patent No.: US 12,773,005 B2
(45) Date of Patent: Oct. 27, 2026

(54) TUBE PACKING APPARATUS

(71) Applicants: Collin A. Renaud, Plainfield, CT (US); Steven A. Gilman, Brooklyn, CT (US)

(72) Inventors: Collin A. Renaud, Plainfield, CT (US); Steven A. Gilman, Brooklyn, CT (US)

( * ) Notice: Subject to any disclaimer, the term of this patent is extended or adjusted under 35 U.S.C. 154(b) by 456 days.

(21) Appl. No.: 18/408,560

(22) Filed: Jan. 9, 2024

(65) Prior Publication Data

US 2024/0225085 A1 Jul. 11, 2024

Related U.S. Application Data

(60) Provisional application No. 63/606,625, filed on Dec. 6, 2023, provisional application No. 63/437,875, filed on Jan. 9, 2023.

(51) Int. Cl.
*A24C 5/39* (2006.01)

(52) U.S. Cl.
CPC ..... *A24C 5/399* (2013.01); *A24C 5/391* (2013.01); *A24C 5/398* (2013.01)

(58) Field of Classification Search
CPC ..... A24C 5/391; A24C 5/398; A24C 5/399
See application file for complete search history.

(56) References Cited

U.S. PATENT DOCUMENTS

2019/0329514 A1* 10/2019 Holderman ..... B65B 1/04

FOREIGN PATENT DOCUMENTS

WO WO-2017172844 A1 * 10/2017 ..... A24C 5/06

* cited by examiner

*Primary Examiner* — Michael H. Wilson
*Assistant Examiner* — Stephanie Lynn Moore
(74) *Attorney, Agent, or Firm* — LORUSSO & ASSOCIATES

(57) ABSTRACT

A particulate delivery and packing apparatus for depositing and compressing particulate material in elongate containers. The containers may have one closed end or two open ends. A modular elongate container magazine is positioned on a base plate of the apparatus to receive a controlled-descent hopper having a plurality of packing tubes extending downwardly from a bottom end of the hopper. Each of the plurality of packing tubes is aligned with a channel in the container magazine and is incrementally lowered into the channel to deposit particulate material. The leading edge of the packing tube compresses the deposited material via an oscillation movement and is incrementally withdrawn to deposit additional particulate material. A vibration-emitting electromagnet/magnetic conductor combination imparts vibration energy to the packing tubes to perform the packing/compression function. Alternatively, a motor applies rotational motion that is converted to a vertical vibratory motion imparted to the packing tubes to perform the packing/compression function.

18 Claims, 21 Drawing Sheets

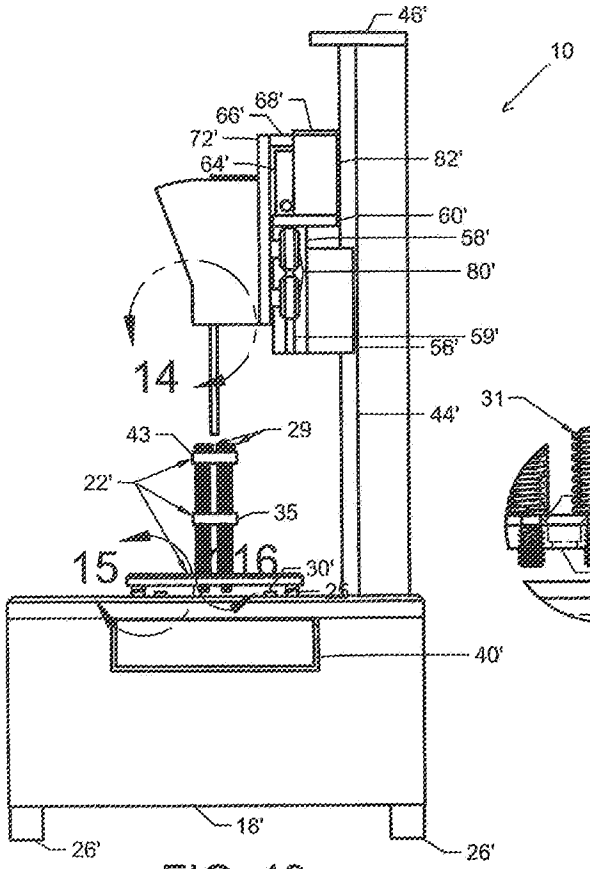
FIG. 13
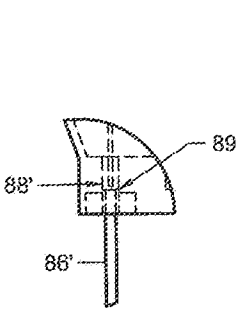
FIG. 16
FIG. 14
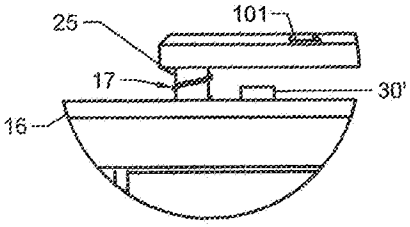
FIG. 15

430
43
42 x 14
45 x 8
47
41
94"

40

10"
14"
42"
56"
44"
122 x 2
52"
46"
60"
62"
350
64"
66"
360
280
68"
70"
400
410
53
106"
16"
240
36"
38"
26"
40"
23"
56"
340 x 2
390
330
320 x 2

90"
105"
230
270
24"
25"
420
70
10
86"

74"
18

72"
79
77
87"

78
76"
290

TUBE PACKING APPARATUS

CROSS-REFERENCE TO RELATED APPLICATIONS

This Regular Utility Application claims the benefit of U.S. Provisional Application No. 63/437,875, filed Jan. 9, 2023, and claims the benefit of U.S. Provisional Application Ser. No. 63/606,625, filed Dec. 6, 2023, the contents all of which are incorporated herein by reference.

FIELD OF THE DISCLOSURE

The disclosure relates broadly to apparatus to load tubes with particulate material and more particularly to apparatus for loading and compacting combustible, leaf or plant-based smoking products into elongate containers. The disclosure further relates to automated tube-loading apparatus.

BACKGROUND OF THE DISCLOSURE

Smoking products have been a part of everyday life for millennia. Of the wide variety of smoking products available, many if not most are now produced through automation. Hand rolling, however, is still a prevalent form of manufacture, and particularly so in the emerging marijuana sector. Papers used to make commercial-grade marijuana cigarettes are often thin and relatively small in cross-sectional diameter relative to common tobacco-based cigarettes. The rather delicate structure of the papers used to make marijuana cigarettes make their preparation challenging for automated devices.

A common method used by dispensaries to prepare such "slim" marijuana cigarettes involves paper-holding jigs and loading cones. A box-like container with a series of spaced cylinder-like container holes holds seven papers at once. The container is placed on a vibration plate that generates randomized, non-directional vibration. A funnel is placed at the top within the conically-shaped paper. The vibration function is activated. Particulate material is fed into each funnel with a scoop. Fork-like dowels are positioned inside each of the papers simultaneously. The dowels have spring dampening to prevent the application of excessive force that could tear the conical paper. The purpose of the dowels is to help push the particulate matter into the paper and pack the particulate matter inside of the paper.

The process of scooping and packing the particulate matter is repeated a few times to produce seven cigarettes. It takes approximately seven minutes to hand-produce seven cigarettes. Although an acceptable cigarette is made with this process, the process overall is very time-consuming considering the low product output per process. What is needed is a process that greatly increases the yield of cigarettes per process performed and improves the quality of the cigarette in terms of uniform density.

Another method currently in use to fill marijuana cigarettes in large batches is known as a Knock Box. The Knock Box apparatus uses a set of stacked components to hold and fill conically-shaped papers. The apparatus includes a base with a plate that imparts vibratory movements when activated. The vibration motion includes a vertical component that results in the plate moving in a vertical direction when activated. A paper magazine is secured to the plate and has 100 vertical channels, each of which is filled with a conically-shaped paper. The bottom end of these papers is closed.

A second magazine is stacked on top of the paper magazine and is formed with 100 vertical channels dimensioned and arranged for each channel to align vertically with a channel in the paper magazine. The channels in the second magazine function as guide chutes to guide particulate material into the open upper ends of the papers. A particulate delivery magazine is aligned with, and stacked upon, the second magazine. The particulate delivery magazine has a series of 100 channels, each of which is positioned to be vertically aligned with a single channel in the paper magazine and a corresponding channel in the second magazine. The particulate delivery magazine is formed with a particulate release slide plate that occludes the bottom ends of each channel. Lateral extraction of the slide plate permits the particulate magazine channels to be open to the lower channels in the second magazine and in the paper magazine.

To operate the knock box, the vibration plate is activated electrically by turning on a switch. Particulate matter is placed on top of the particulate magazine and allowed to fall into the channels until the channels are filled. The slide plate prevents the particulate matter from downwardly exiting the particulate magazine. With the vibration plate activated, the bottoms of the conical papers are struck by the vibration plate to jar them vertically. Next, the slide plate is quickly extracted laterally to allow the particulate material to fall from the particulate delivery magazine into the channels of the second alignment magazine and into the open ends of the conical papers in the paper magazine. The vibrating plate repeatedly strikes the bottom ends of the papers and facilitates the particulate material to fill the conical papers by mechanical agitation of the particulate material. With the papers filled, the vibration plate is deactivated. The particulate magazine and the second alignment magazine are removed from the top of the paper magazine. The paper magazine is next rapidly pulled forward to expose the bottom ends of the paper magazine channels. This allows the filled conical papers to be released from the paper magazine. The tops of the papers are next folded to enclose the particulate matter in a finished marijuana cigarette.

Although the Knock Box is effective in filling a large number of conical cigarette papers in one process, there are several drawbacks to this system. Perhaps the most significant problem is the rather aggressive physical contact between the conical papers and the vibration plate. The method of physically contacting the papers with the steel plate in an oscillating pattern is not amenable to thin papers that can easily be crushed. The method also is not amenable to elongate particulate material containers that are open-ended. There is the possibility of the paper getting wrinkled and filled without a consistent density throughout.

Although the Knock Box can prepare one-hundred cones per run, it is more of a process, something that requires more than one operator and the operators have to go through a learning curve to know how to use the system and become proficient. To use the knock box, all one-hundred cones have to be dropped in by hand. The particulate delivery magazine or tray holds a set amount of flour drops the flour into the cones while the cones are jumping and packing. The tray has to be filled a second time and the particulate material dropped in the cones again to complete the filling process. The cones then need to be either twisted or folded over manually at the top ends. A proficient team can perform a run in about 10 minutes. What is needed is an automated process that can quickly load elongate containers into the apparatus and deposit the particulate material into the elongate containers in an efficient, continuous manner. What is further needed is an apparatus that requires little or no experience to operate, an apparatus that can run hands-off. These and other objects of the disclosure will become apparent from a reading of the following summary and detailed description of the disclosure.

SUMMARY OF THE DISCLOSURE

In one aspect of the disclosure, a particulate depositing apparatus includes a series of components to deposit particulate material in particulate-receiving tubes. A hollow base unit supports a modular tube-receiving magazine formed with a plurality of vertically-aligned channels structured to each receive a particulate-receiving tube or container. A tube-filling tower is secured to a top of the base. The tube-filling tower has a z-axis carriage secured to a lead screw, the base of which is secured within the base to a stepper motor. A pair of guide rails secured to the tube-filling tower and fit within shape-conforming slots in the z-axis carriage to maintain the carriage's alignment during vertical motion.

A sliding carriage is secured to the z-axis carriage and provides a mounting structure for further elements of the apparatus. A hopper is secured to a front face of the sliding carriage. A plurality of packing tubes are secured to, and extend downwardly from, a bottom of the hopper. An electromagnet is secured to the z-axis carriage along with a magnetic conductor spaced from the electromagnet. Stand-off springs maintain the distance between the electromagnet and the magnetic conductor. An end of the magnetic conductor is directly connected to the sliding carriage and therefore, indirectly to the hopper.

After the hopper is filled and the elongate containers are positioned in the magazine channels, a computer-implemented program is initiated to activate the electromagnet to cause the magnetic conductor to vibrate. The vibration is imparted to the hopper that causes particulate material loaded in the hopper to flow downwardly in the packing tubes. Simultaneously, the stepper motor is operated to incrementally insert the packing tubes into the elongate containers. As the particulate materials flows from the packing tubes to the elongate containers, the leading edges of the packing tubes are serially oscillated in the elongate containers to pack the deposited particulate material. Each additional layer of particulate material deposited in the elongate containers is compressed by the downward phase of the packing tube oscillation. Once the elongate containers are filled and packed, the hopper is raised to permit the tube-receiving magazine to be removed from the apparatus to retrieve the filled elongate containers.

In another aspect of the disclosure, a particulate depositing apparatus includes a hollow base unit that supports a modular tube-receiving magazine that is releasably secured to a surface of the base. Computer control elements are secured within the base unit. A plurality of vertically-aligned channels structured to each receive a particulate-receiving tube or container are formed in the magazine. A tube-filling tower is secured to a top of the base. The tube-filling tower has a z-axis carriage secured to a lead screw, the base of which is secured within the base to a stepper motor. A pair of guide rails secured to the tube-filling tower and fit within shape-conforming slots in the z-axis carriage to maintain the carriage's alignment during vertical motion.

A sliding carriage is secured to the z-axis carriage and provides a mounting structure for further elements of the apparatus. A hopper is secured to a front face of the sliding carriage. A plurality of packing tubes are secured to, and extend downwardly from, a bottom of the hopper. Hopper alignment wheels are secured to the hopper via axles and ride within hopper guide channels to maintain the alignment of the hopper during vertical motion. An electromagnet is secured to the z-axis carriage along with a magnetic conductor spaced from the electromagnet. Stand-off springs maintain the distance between the electromagnet and the magnetic conductor. At least one chatter weight is secured via shafts to the magnetic conductor. An end of the magnetic conductor is directly connected to the sliding carriage and therefore, indirectly to the hopper.

After the hopper is filled and the elongate containers are positioned in the magazine channels, a computer-implemented program is initiated to activate the electromagnet to cause the magnetic conductor to vibrate. The vibration is imparted to the hopper that causes particulate material loaded in the hopper to flow downwardly in the packing tubes. The vibration causes the chatter weights to undulate along the shafts to provide a vibration-frequency interruption. Simultaneously, the stepper motor is operated to incrementally insert the packing tubes into the elongate containers. As the particulate materials flows from the packing tubes to the elongate containers, the leading edges of the packing tubes are serially oscillated in the elongate containers to pack the deposited particulate material. Each additional layer of particulate material deposited in the elongate containers is compressed by the downward phase of the packing tube oscillation. Once the elongate containers are filled and packed, the hopper is raised to permit the tube-receiving magazine to be removed from the apparatus to retrieve the filled elongate containers.

In a yet further aspect of the disclosure, the z-axis carriage includes a motor mount with a motor attached thereto. The z-axis carriage translates along a vertically-aligned lead screw. An offset plate is secured to a face of the motor. An offset plate post with a threaded bore is secured to the offset plate offset from a center point of the offset plate. A connecting rod is attached at one end to the offset plate post with a bolt or similar mechanical fastener. A second connecting rod end has a second bolt that attaches to a bearing secured to the top of a hopper back plate. The hopper back plate is secured to the back surface of a hopper container. A base plate registers against the bottom surface of the hopper container and is secured to a bottom end of the hopper back plate. A vibration carriage is secured to a front face of the z-axis carriage and has a slot to receive a vibration guide rail that is attached to the hopper back plate. The vibration guide rail can translate axially within the vibration carriage slot. Rotational movement of the motor produces a vertical motion of the hopper/hopper back plate assembly.

A gas strut is used to relieve the weight the z-axis carriage applied to the lead a screw. A dampener reduces the transfer of any vibrational energy to the components of the tube packing apparatus other than the hopper assembly. The hopper assembly includes a mixing flap secured to an axle with offset weights secured to the ends of the axle. Activation of the motor causes the vibration of the hopper assembly, which in turn causes the offset weights to rotate the axle and cause the mixing flap to contact particulate matter in the hopper so as to stir, mxi and break up any particulate matter clumps. These and other aspects of the disclosure will become apparent from a review of the appended drawings and a reading of the following detailed description of the disclosure.

BRIEF DESCRIPTION OF THE DRAWINGS

FIG. 13 is a side view in elevation of the tube packing apparatus shown in FIG. 10.

FIG. 14 is a cut-away, sectional view in partial phantom of a hopper/packing tube junction according to the embodiment of the disclosure shown in FIG. 10.

FIG. 15 is a cut-away, sectional view of a magazine alignment and support subassembly according to the embodiment of the disclosure shown in FIG. 10.

FIG. 16 is a cut-away, sectional view of a magazine/spring subassembly according to the embodiment of the disclosure shown in FIG. 10.

DETAILED DESCRIPTION OF THE DISCLOSURE

Figure 1:
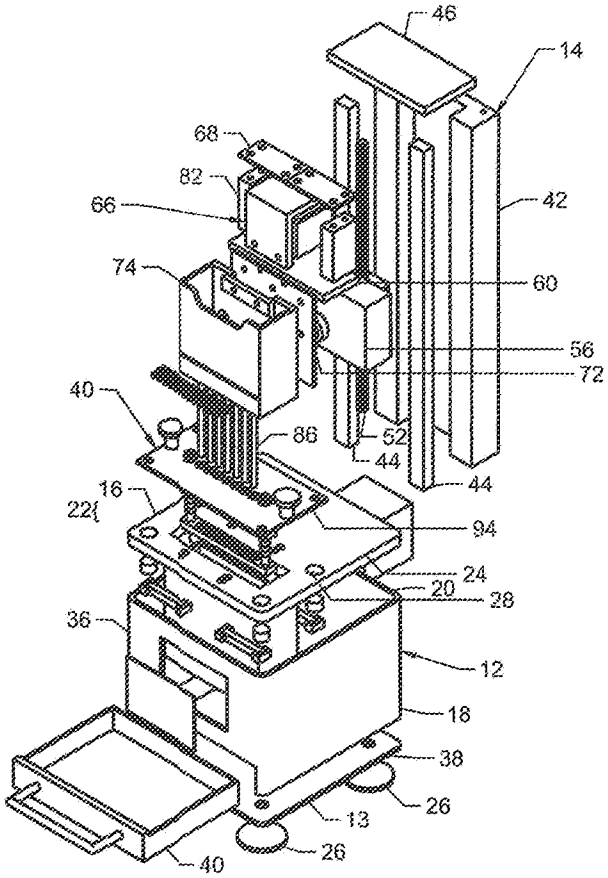
FIG. 1 is a top side exploded perspective view of a tube packing apparatus according to one embodiment of the disclosure.
Figure 2:
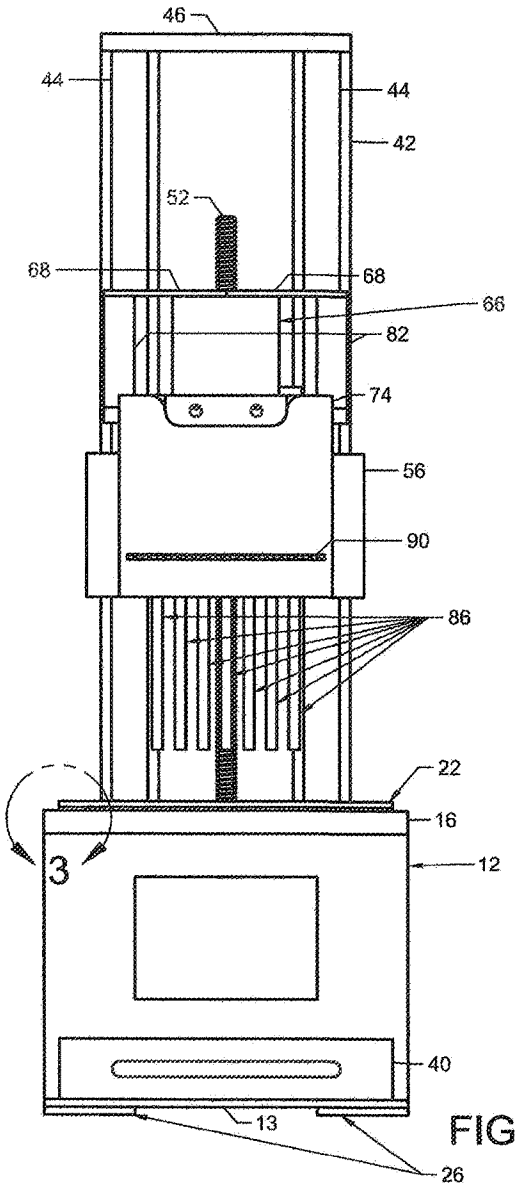
FIG. 2 is a front view in elevation of the tube packing apparatus shown in FIG. 1.
Figure 3:
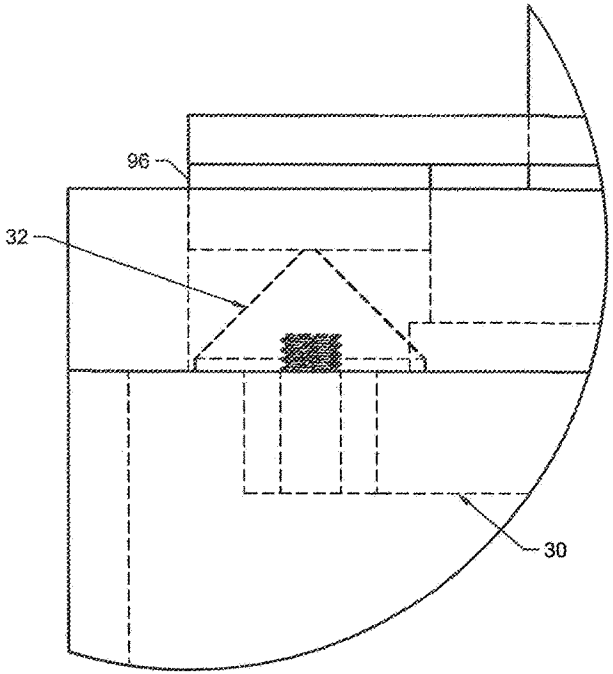
FIG. 3 is a cut-away, sectional view in partial phantom of a magazine alignment and support subassembly according to the embodiment of the disclosure shown in FIG. 1.
Figure 6:
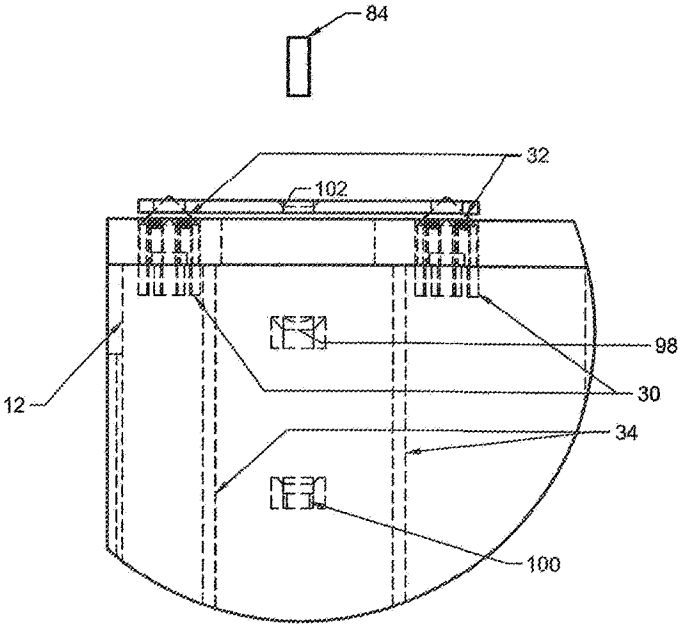
FIG. 6 is a cut-away sectional view in partial phantom of a magazine support plate according to the embodiment of the disclosure shown in FIG. 1.
Figure 5:
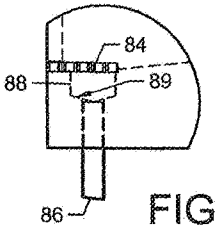
FIG. 5 is a cut-away sectional view in elevation of a hopper/filling tube juncture according to the embodiment of the disclosure shown in FIG. 1.
Figure 4:
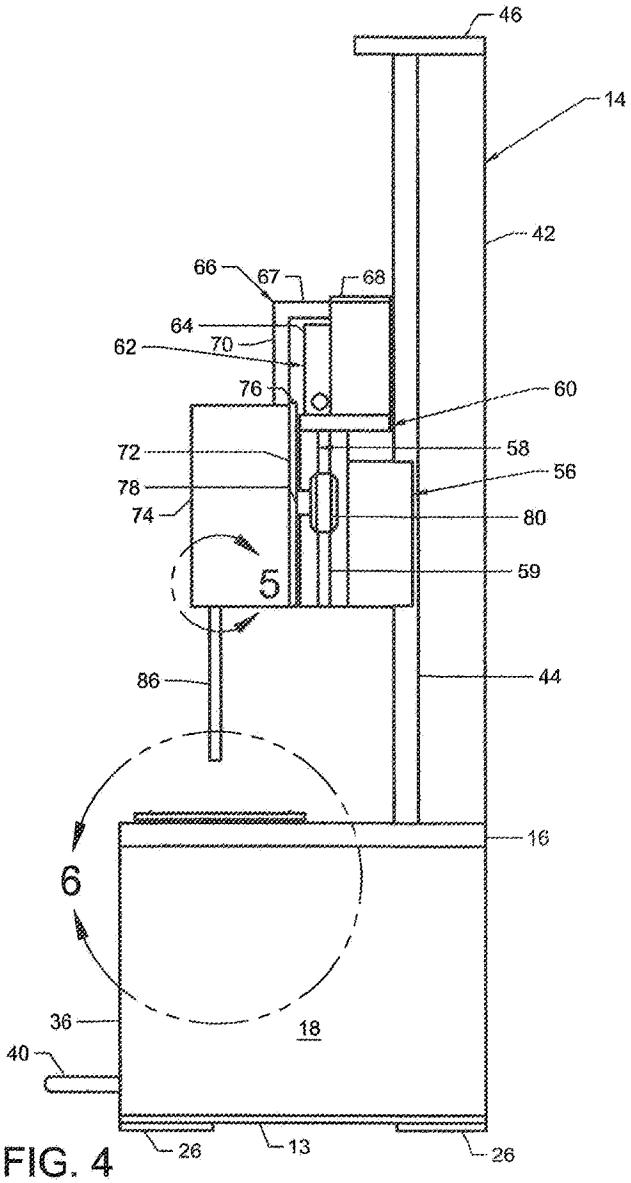
FIG. 4 is a side view in elevation of the tube packing apparatus shown in FIG. 1.
Figure 7:
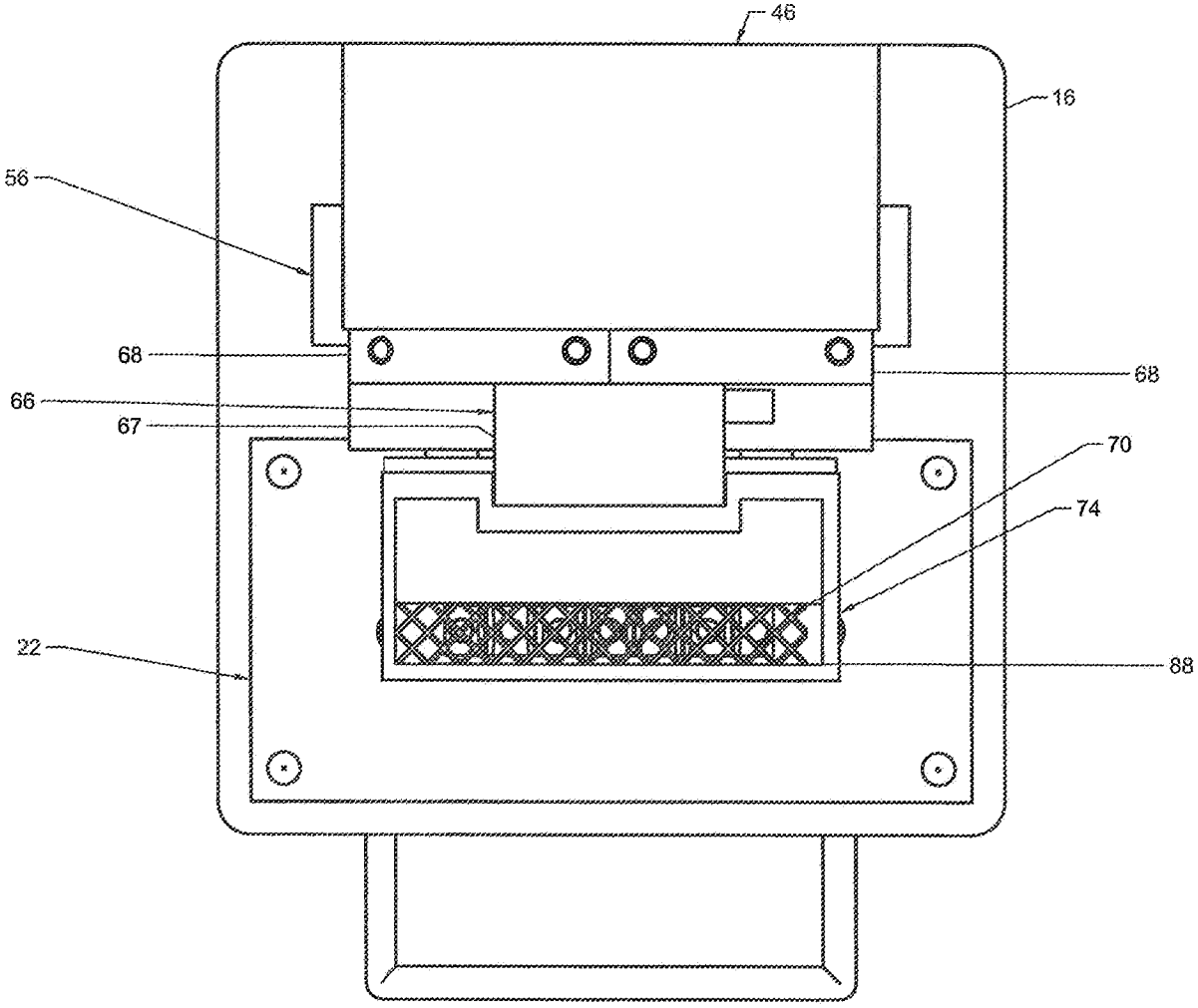
FIG. 7 is a top view of the tube packing apparatus shown in FIG. 1.
Figure 8:
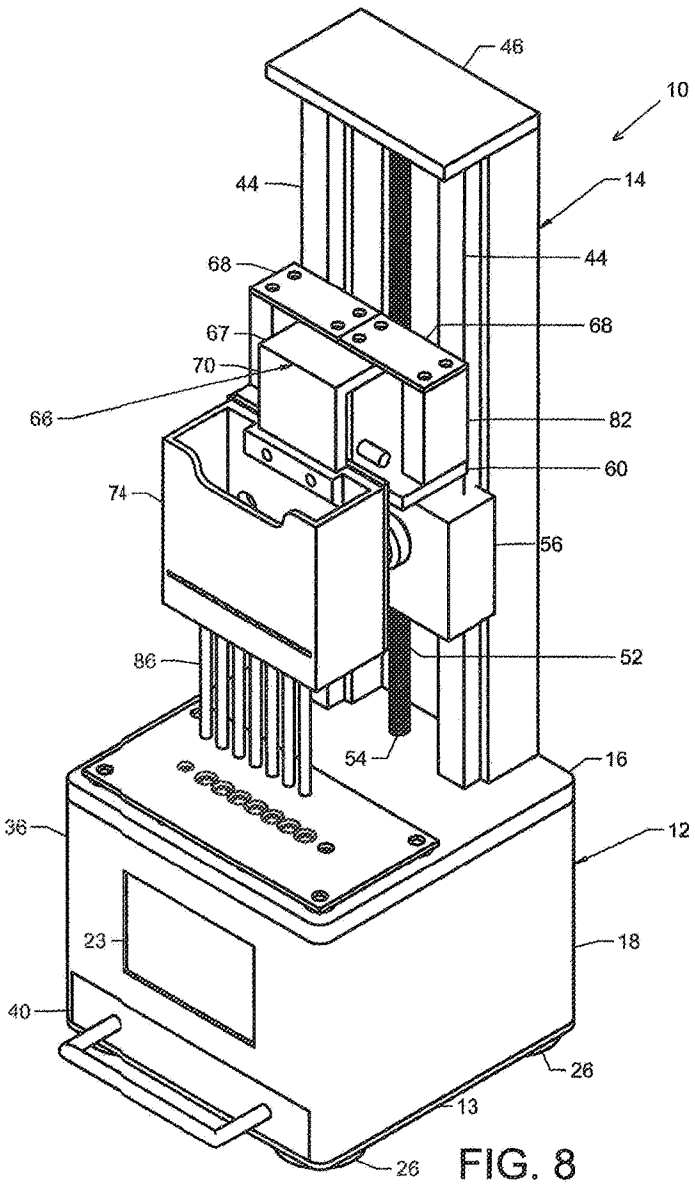
FIG. 8 is a top front end perspective view of the tube packing apparatus shown in FIG. 1.
Figure 9:
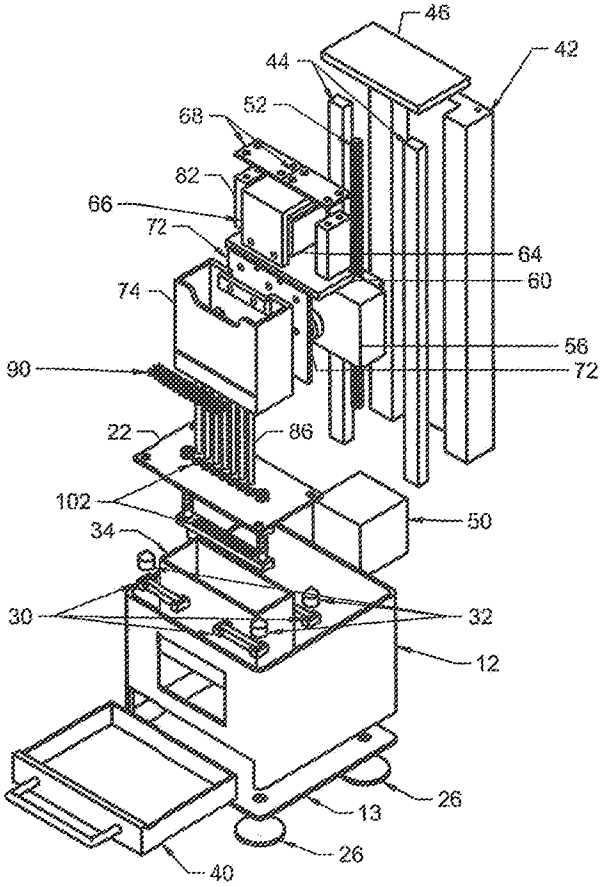
FIG. 9 is a top side exploded perspective view of the packing apparatus shown in FIG. 1.
Figure 10:
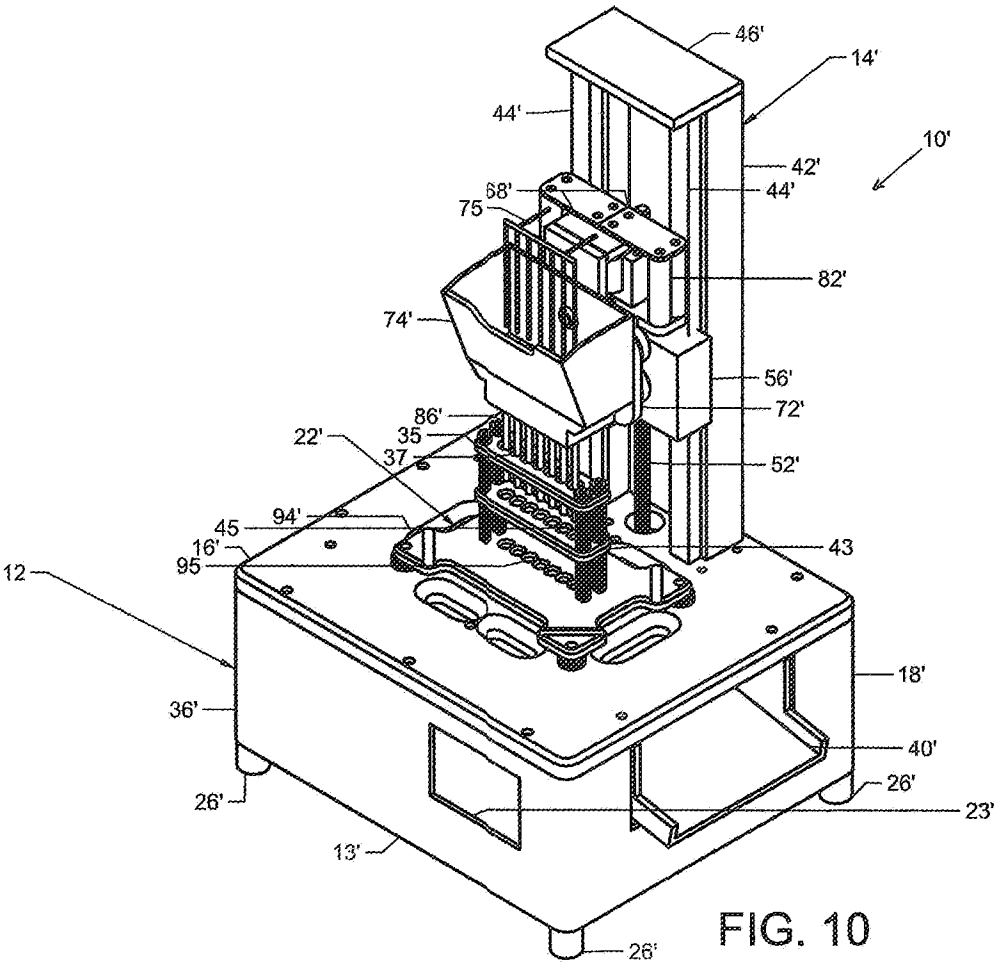
FIG. 10 is a top side perspective view of a tube packing apparatus according to another embodiment of the disclosure.
Figure 11:
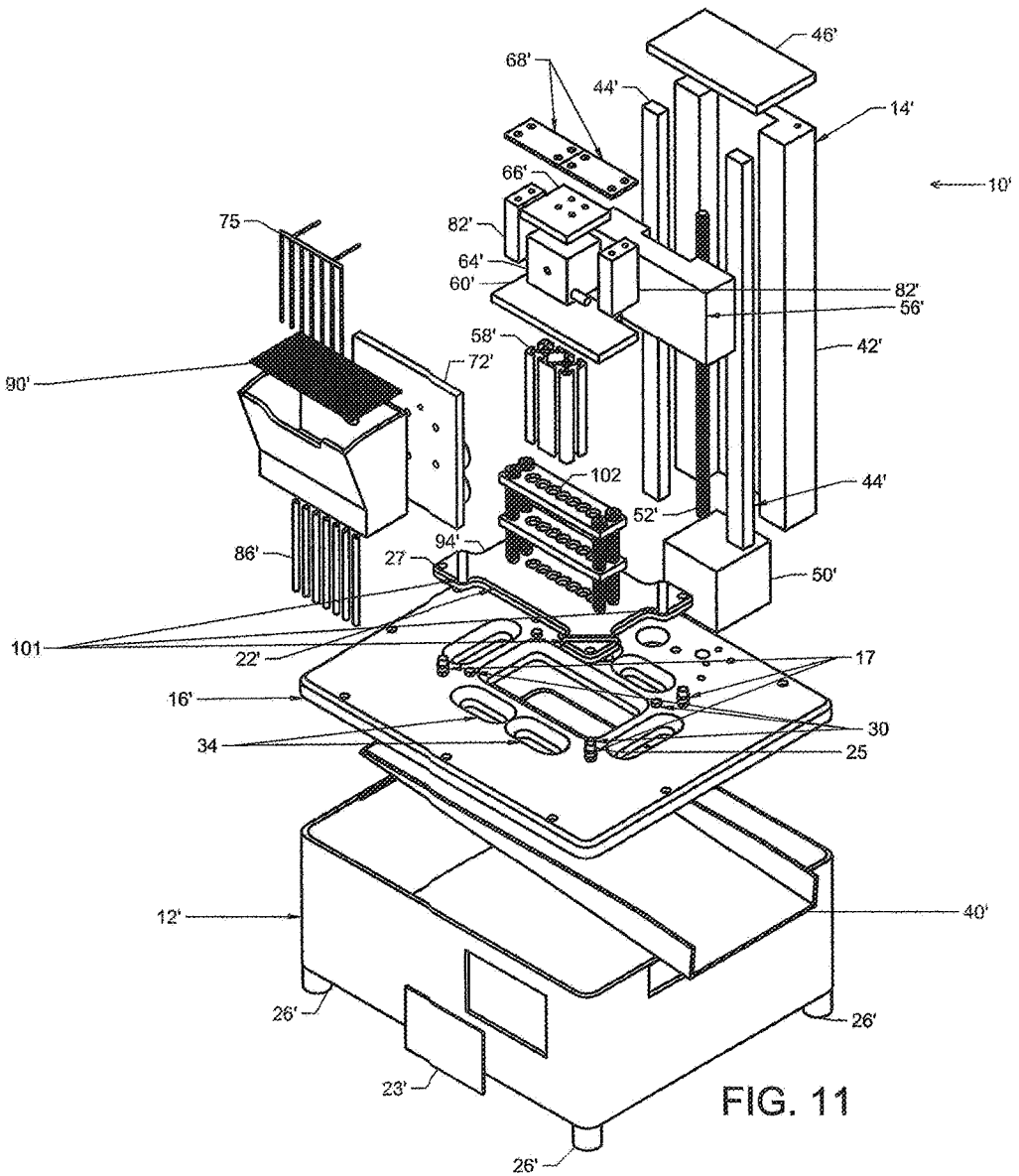
FIG. 11 is a top side exploded perspective view of the tube packing apparatus shown in FIG. 10.
Figure 12:
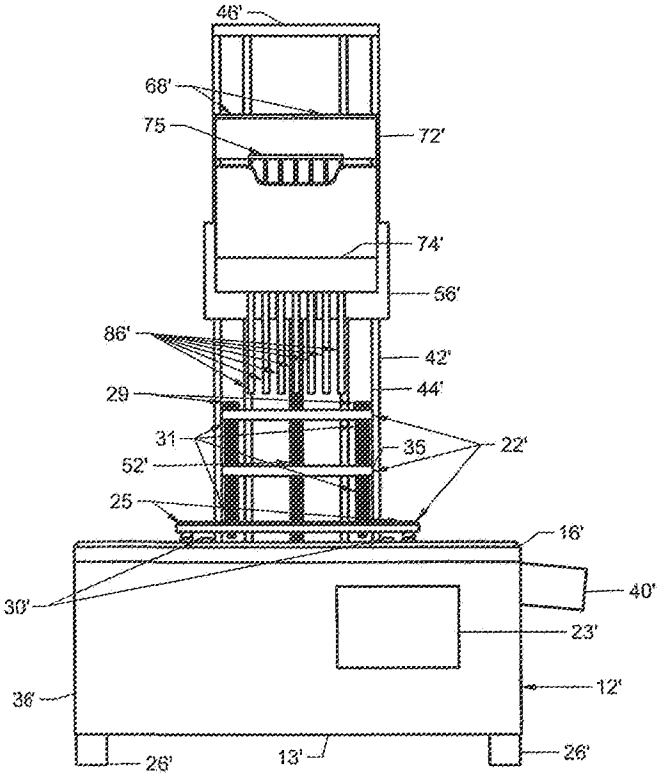
FIG. 12 is a front view in elevation of the tube packing apparatus shown in FIG. 10.
Figure 17:
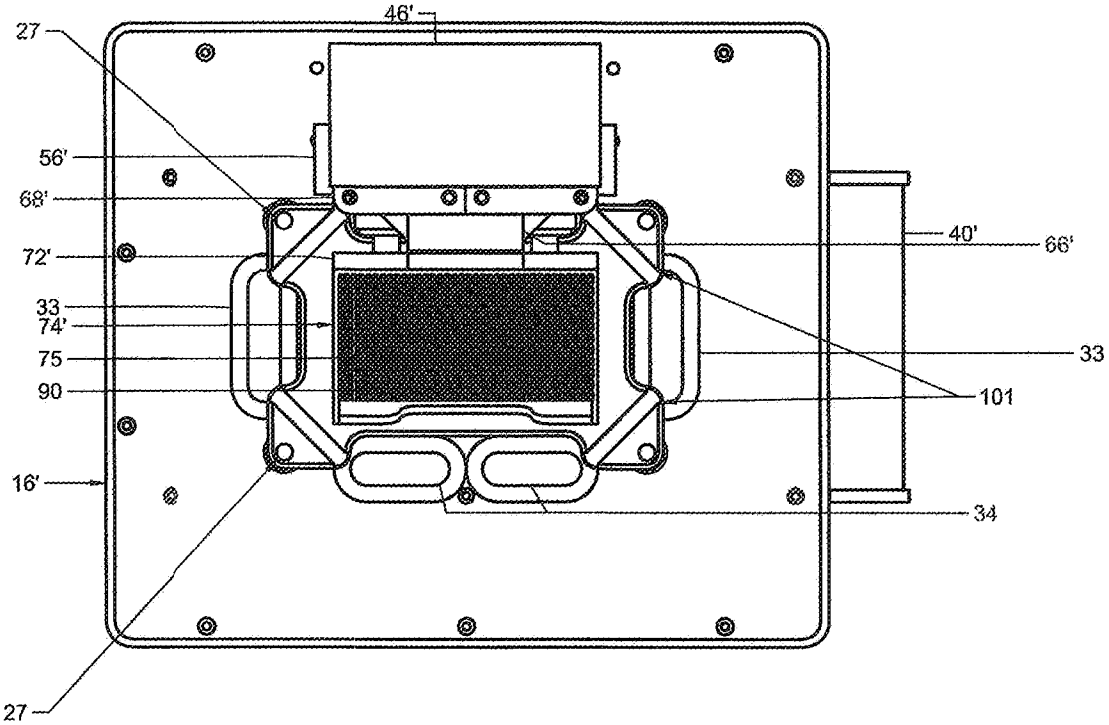
FIG. 17 is a top view of the tube packing apparatus shown in FIG. 10.
Figure 18:
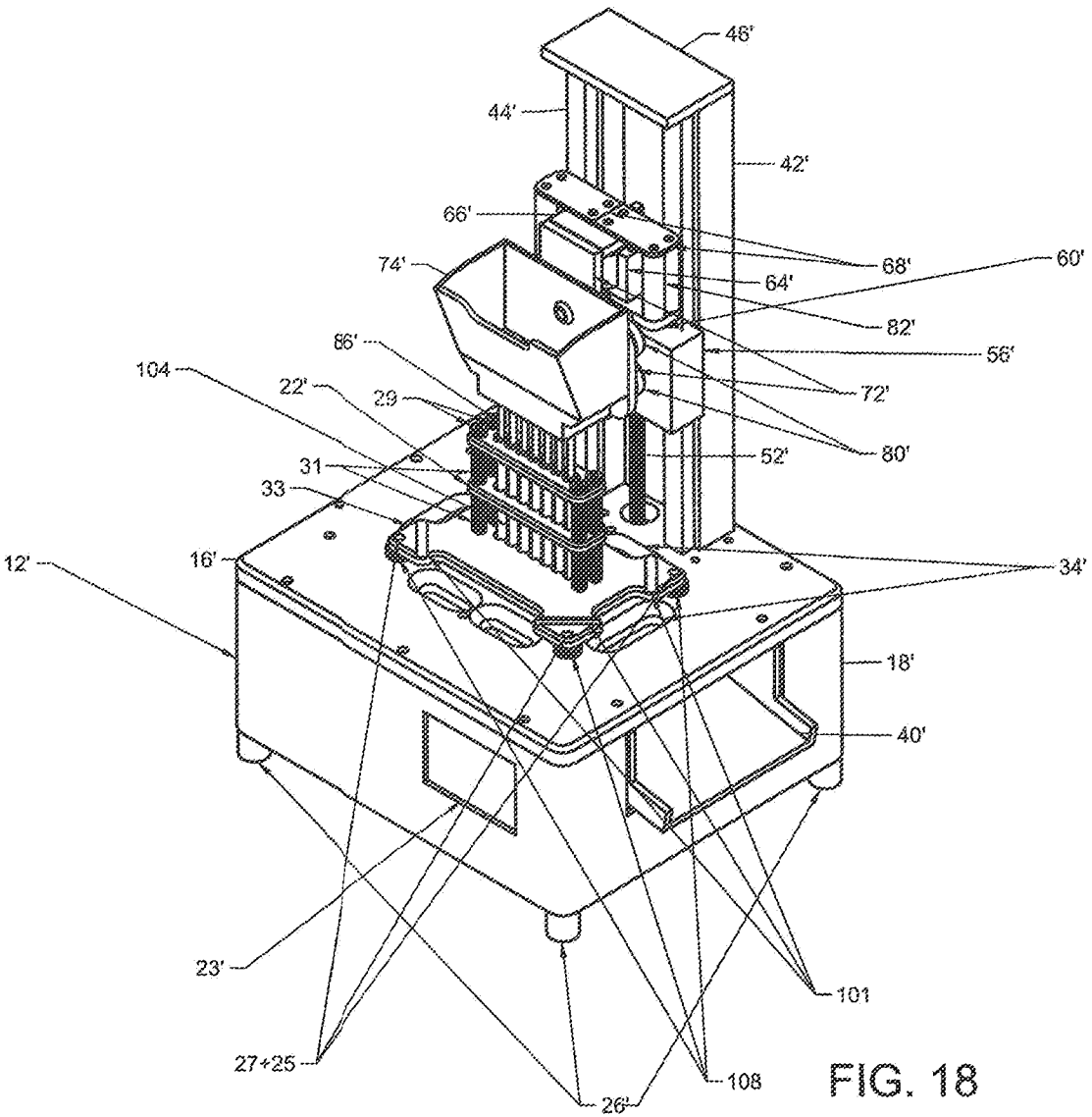
FIG. 18 is a top side perspective view of the tube packing apparatus shown in FIG. 10.

Referring now to FIGS. 1-9, in one aspect of the disclosure, a tube packing apparatus, designated generally as 10, includes broadly a magazine support base 12 and a tube-filling tower 14. Magazine support base assembly, designated generally as 12, is a cube-shaped hollow structure that houses several elements of tube packing apparatus 10 including a paper-holding magazine assembly disclosed in more detail herein. Tube-filling tower 14 includes a hopper/filling-packing tube subassembly disclosed in more detail herein.

Magazine support base 12 has a main mounting plate 16 secured to the top ends of support base walls 18 that combined with a bottom end 13 define a chamber 20 to receive a magazine subassembly 22. Portions of main mounting plate 16 define an opening 24 dimensioned to receive magazine subassembly 22. In one embodiment, opening 24 is substantially rectangularly-shaped. It should be understood that the overall shape of opening 24 can take on any regular or irregular shape and remain within the scope of the disclosure. A series of locator bores 28 are formed outside the corners of opening 24. Locator bores 28 function to align magazine subassembly 22 to other components of the tube packing apparatus as disclosed in more detail herein.

Positioned below each locator bore 28 is a load cell 30 that detects forces, particularly downward forces, applied to magazine assembly 22. Load cells 30 actively detect downward force/weight throughout the tube packing process performed by the apparatus. The force readings are sent to a processing unit (not shown) that processes the force data with respect to algorithms programmed into the computer-controlled apparatus. Conical pressure points 32 are positioned above each load cell 30 ensure positive contact with magazine subassembly 22 as disclosed in more detail herein.

Positioned within support base 12, proximal to a bottom end 13 is a drain chute 34 dimensioned to catch any particulate matter escaping the magazine subassembly 22. A front wall 36 of support base 12 has portions defining a catch tray opening 38 dimensioned to receive a catch tray drawer 40 in sliding engagement. Catch tray drawer 40 may include a handle or grasping bar to facilitate tactile insertion and removal of the drawer from support base 12. Catch tray drawer 40 is oriented and positioned to be below drain chute 34 when positioned within support base 12 to function as a particulate retrieval device to facilitate the organized collection and removal of any disperse particulate material that emerges out of magazine subassembly 22. A touch screen 23 is positioned on support base 12 on either a front wall or a side wall to provide a computer-implemented interface to control the apparatus functions. It should be understood that the control panel could be operated via remote control or have the touch screen placed on a support separate from support base 12 via wired or wireless connection.

Due to the use of vibratory forces to implement the tube packing function, support base 12 may include base feet 26 secured to each corner of bottom end 13. Base feet 26 may be formed from an elastomeric material such as silicone to provide shock absorption to prevent the transmission of the vibratory forces to any surface upon which the tube packing apparatus is placed. By functionally decoupling the support surface from the main components of apparatus 10, the apparatus should remain stationary on the support surface. Base feet 26 provide the added function of adjusting for any uneven surfaces that may be used to support apparatus 10.

Tube-filling tower 14 comprises a series of components including a vertically-oriented extrusion tower 42 having a bottom end secured to a back end of a top surface of main mounting plate 16. A pair of parallel, vertically-oriented linear guide rails 44 are secured to a front surface of extrusion tower 42 and provide a structural means to permit axial translation and functional alignment of the tube filling/packing components of apparatus 10. A top tower plate 46 is secured to a top end of extrusion tower 42 to function as a z-axis maximum height stop for the tube filling/packing components. Top tower plate 46 further functions as a solid surface against which the hopper vibrates, disrupting the smooth sine wave of the vibration. This disruption facilitates removal of particulate matter, i.e., undoes any clogging, from the tube filling/packing components. It should be understood that this secondary function is additive to the primary source of the vibratory force as disclosed in more detail herein. Alternatively, a stop block (not shown) can be secured to extrusion tower 42 to function as a z-axis stop.

Secured within support base 12 proximal a back end of the support base is a stepper motor 50 that permits the incremental movement of the sliding components of the apparatus. A lead screw 52 is secured to step motor 50 and extends axially through a lead screw bore 54 formed in main mounting plate 16 and along a midpoint between linear guide rails 44. Rotation of lead screw 52 provides the functional means to impart vertical movement of the sliding components of the apparatus. A top end of the lead screw may or may not be anchored to extrusion tower 42.

A z-axis carriage 56 is secured to lead screw 52 with a threaded nut having threading matched to the threading of the lead screw. Rotation of lead screw 52 causes z-axis carriage 56 to move in an axial direction, either upwardly or downwardly depending upon the direction of lead screw rotation. In one direction, rotation of lead screw 52 will cause the z-axis carriage to move upwardly. In the opposite direction, rotation of lead screw 52 will cause the z-axis carriage to move downwardly. Control of the lead screw rotation is accomplished via computer.

To stabilize and align the orientation of z-axis carriage 56 to the stationary components of the apparatus, the z-axis carriage is formed with two parallel guide-rail-receiving slots (not shown) that each conform to the shape of guide rails 44 in cross section. The slots are formed on the back end of the carriage and extend from a bottom surface to a top surface of the carriage. Bearings, such as ball bearings or linear bearings are used to facilitate axial translation of the z-axis carriage along the guide rails.

Secured to each side of z-axis carriage 56 is a dedicated slide track 58. Each slide track 58 is oriented vertically with opposing sidewalls and a v-groove formed down a centerline of the slide track. The v-groove provides lateral alignment for other vibratory components of the apparatus described in more detail herein.

Secured to a top surface of z-axis carriage 56 is a magnet assembly mounting plate 60. Mounting plate 60 provides a stable, planar surface to mount an electromagnetic vibration subassembly 62 that includes an electromagnet 64 connected to a power source. Suspended about electromagnet 64 within the flux range of the electromagnet is a magnetic conductor 66 in the form of an angle iron. A first angle-iron edge 68 of magnetic conductor 66 is attached to first ends of a pair of vibration-decoupling springs 68. Second ends of the springs are attached to z-axis carriage 56. A second angle-iron edge 70 of magnetic conductor 66 is secured to a slide carriage 72. Magnetic conductor 66 functions as a magnetic conductor attracted to magnetic flux emitted by activation of electromagnet 64. It should be understood that other means may be used to impart a vibration force and remain within the scope of the disclosure. Illustratively, mechanical subassemblies, e.g., motorized vibration-emitting devices may be used in conjunction with, or as a substitute for the electromagnet/magnetic conductor assembly.

Slide carriage 72 is a vertically-oriented mounting plate structured and dimensioned to receive and support a hopper assembly 74 described in more detail herein. A top slide-carriage end 76 is secured to second angle-iron edge 70 and is essentially suspended from the magnetic conductor 66. Extending laterally from a back side of slide carriage 72 are a pair of spaced slide wheel axles 78. Secured to each axle is a slide wheel 80 that rotates about the axle. Perimeter edges of each slide wheel 80 registers against and rotates along a slide track 58 within the v-groove that provides positive lateral alignment during operation of the apparatus. Cooperation between slide wheels 80 and slide tracks 58 ensure proper omnidirectional alignment of slide carriage 72 relative to the fixed components of the apparatus during operation. Omnidirectional alignment is of significant importance since the apparatus is being used to fill paper tubes having circular cross-sections. With this configuration, the only axis subject to variation is the z-axis. This ensures continual static alignment along the x and y axes during operation. It should be understood that multiple pairs of slide wheels can be connected via axles to slide carriage 72 and rotate within the confines of slide tracks 58 to improve the omnidirectional alignment.

A pair of standoff springs 82 constructed in axial tension are secured between electromagnet 64 and magnetic conductor 66 to maintain a precise gap between the electromagnet and magnetic conductor to optimize the vibratory response to electromagnetic activation. Springs in axial compression also may be used for this purpose. The combination of standoff springs 82 and decoupling springs 68 provide vibratory isolation of the slide carriage/hopper assembly from the static components of the apparatus.

Secured to a front face of slide carriage 72 is a modular hopper assembly 74. The hopper assembly is modular to permit different hoppers to be used with differently sized elongate containers. Hopper assembly 74 has four walls that may be straight or slope inwardly toward a bottom end formed with a plurality of tube bores 84 arranged is a grid pattern if multiple rows or in a line pattern if configured in a single row. Secured within each tube bore is a vertically-oriented, elongate particulate delivery and packing tube 86. Each tube provides a precise vertical pathway for particulate material to be deposited in cylindrically-shaped papers or like-shaped objects. The cross-sectional diameters of the packing tubes are set to slide within cylindrical papers secured in the apparatus. The outer surfaces of the packing tubes may or may not register against and slide along the inner surfaces of the cylindrical papers. No to minimal contact has shown to produce the best product. Leading edges of each packing tube 86 provide a means to compress particulate material deposited in the cylindrical papers as disclosed in more detail herein. An optional qualifying screen 90 may be secured in hopper assembly 74 to filter particulate material based upon size.

In an alternative embodiment, each packing tube 86 may be formed with flared or flanged leading end that improves the packing function. Use of a flanged end creates a larger packing surface area and should help to prevent or control clogging. It should be understood that the flange diameter must be less than the inside diameter of the elongate containers.

Each tube bore 84 is formed with a counterbore 88 having a shallow-sloped bottom annular surface that promotes migration of particulate material into packing tube 86 Use of a counterbore provides readily available particulate material for transfer through the packing tube without all the weight of the particulate material in the hopper bearing on the single packing tube and tube bore. In an alternative embodiment, each packing tube 86 is positioned in each tube bore 84 with a top end extending above the bottom surface of hopper assembly 74. This further prevents clogging of the packing tubes by removing the tube top ends from the particulate material at the very bottom of the hopper that may be compressed from the weight of the particulate material in the hopper assembly.

Paper-holding magazine subassembly 22 includes a substantially flat surface plate 94 having locator feet 96 extending axially below each corner of plate 94. Locator feet 96 are dimensioned to fit within locator bores 28 to provide alignment along x and y axes and to vertically align the magazine subassembly with the hopper assembly 74. Magazine subassembly 22 has a main body formed below surface plate 94 with a series of vertically-oriented paper tube bores 98 formed therein and dimensioned to receive cylindrically-shaped papers used to receive particulate material. The paper tube bore arrangement, e.g., a grid or line pattern is set to perfectly match the grid or line arrangement of the packing tubes 86. The cross-sectional diameters of the paper tube bores are set to receive in a tight tolerance arrangement, the paper tubes. It should be understood that the number of packing tubes and tube bores is scalable. It also should be understood that the use of a modular magazine permits the rapid filling of cylindrical papers by using multiple magazines. When one magazine has been completely processed, the magazine can be removed and replaced with another magazine loaded with unfilled cylindrical papers.

Formed at the bottom of each paper tube bore 98 is a reduced-diameter drain hole 100. Drain holes 100 are defined by annular paper tube shoulders that function as a stop for the paper tubes. The drain holes permit particulate material not compressed in the paper tubes to exit the paper tubes into the drain chute 34 for collection and reuse.

Formed at a top end of each paper tube bore 98 is a lead-in chamber 102. Lead-in chamfer 102 facilitates the loading of paper tubes into paper tube bores 98. It should be noted that chamfer 102 does not perform the function of aligning the packing tubes 86 with the tube bores. The packing tubes must be aligned independently of the chamfers and should not contact the top ends of the elongate containers.

Having described the structural features of the tube packing apparatus, an exemplary explanation of the method of packing paper tubes with particulate material is provided. It should be understood that the method steps described herein do not necessarily have to be performed in the order described. To commence the tube-packing function, magazine subassembly 22 is filled with paper tubes. The filling function can be performed with the magazine subassembly assembled to the apparatus or maintained separate from the apparatus. With the magazine subassembly filled with paper tubes and positioned in apparatus 10, hopper assembly 74 is filled with particulate material. Via computer-implemented activation, stepper motor 50 rotates lead screw 52 to lower the slide carriage/hopper assembly toward magazine subassembly 22. Once the packing tubes 86 have entered the paper tubes and travel downwardly proximal the bottom end of the paper tubes, electromagnet 66 is energized with AC current to take advantage of the 60 Hertz cycling that caused the electromagnet to emit pulsating flux lines. The fluctuating flux lines cause magnetic conductor 64 to vibrate. The vibratory force is transferred to slide carriage 72 and hopper assembly 74. This force also is applied to the particulate material that flows downwardly via gravitational force and vibratory agitation and deposits in the paper tubes. As the vibration force is applied, step motor 50 creates a z-axis oscillation that causes the leading edges of packing tubes 86 to compress and pack particulate material in the paper tubes below the packing tube leading edges.

The compression effect can be applied in a linear or variable frequency approach. As the slide carriage/hopper assembly is incrementally retracted to further fill the cylindrical papers, the constantly-applied vertical oscillating motion of the packing tubes has the effect of depositing particulate material in a vertical ascending manner with a compression function being applied to the particulate material most recently deposited. This ensures uniform density of the particulate material column formed in the paper tube. Once the packing tubes have been fully retracted from magazine subassembly 22, the slide carriage/hopper assembly can be fully retracted for the next round of tube packing.

One significant advantage of the computer-implemented tube packing method is the ability to provide variable-rate packing. With each compression event, the particulate material most recently deposited is compressed. The compression event, however, also applies compression to previously deposited layers that have undergone compression events. The lowest layers experience the highest numbers of compression events. Due to the buildup of compression events, the need for constant-rate compression events diminishes with each compression event. To adjust for this, the compression rate can be made variable with the highest rate applied at the beginning of the particulate deposit function and a reduced rate applied as the deposit function approaches the fully-filled condition. This further ensures uniform density of the particulate material throughout the particulate column formed in the cylindrical papers.

Referring now to FIGS. 10-22, in another aspect of the disclosure, a tube packing apparatus, designated generally as 10', includes broadly a magazine support base 12' and a tube-filling tower 14'. As used herein, identical reference characters having differently primed or unprimed variations and assigned to features of the disclosure are intended to identify different embodiments of the same feature. Magazine support base assembly, designated generally as 12', is a cube-shaped hollow structure that houses several elements of tube packing apparatus 10' including hardware for computer-implemented control. A removable elongate-container holding magazine subassembly 22' is releasably secured to base assembly 12'. Tube-filling tower 14' includes a vertically-movable hopper/filling-packing tube subassembly disclosed in more detail herein.

Magazine support base 12' has a main mounting plate 16' secured to the top ends of support base sidewalls 18', a back wall and a front wall 36' that combined with a bottom end 13' define a chamber 20' that houses electronic controls as well as a stepper motor/lead screw assembly disclosed in more detail herein. Portions of main mounting plate 16' define an opening 24' dimensioned to receive portions of magazine subassembly 22'. In one embodiment, opening 24' is substantially rectangularly-shaped. It should be understood that the overall shape of opening 24' can take on any regular or irregular shape and remain within the scope of the disclosure. A series of locator pins 25 are secured outside the corners of opening 24'. Locator pins 25 function to align magazine subassembly 22' to other components of the tube packing apparatus as disclosed in more detail herein.

In one embodiment, positioned on top of main mounting plate 16 proximal to locator pins 25 and proximal to the perimeter edge of opening 24' are at least one load cell 30' that detect forces, particularly downward forces, applied to magazine subassembly 22'. Load cell(s) 30' register against a bottom surface of magazine subassembly 22' and actively detect downward force/weight applied to magazine subassembly 22' throughout the elongate-container packing process performed by the apparatus. The force readings are sent to a processing unit (not shown) that processes the force data with respect to algorithms programmed into the computer-controlled apparatus.

Positioned within support base 12', proximal to a bottom end 13' is a drain chute 34' dimensioned to catch any particulate matter escaping the magazine subassembly 22'. One of the two sidewalls 18' has portions defining a catch tray 40' that extends outwardly from the sidewall and is oriented to have an angular decline to facilitate the movement out of the apparatus of particulate material that falls out of the elongate containers during the filling and packing process. Catch tray 40' is oriented and positioned to be below a drain chute 34' that functions to catch stray particulate material that falls out of the elongate containers for removal and/or reuse. Catch tray 40' functions as a particulate retrieval device to facilitate the organized collection and removal of any disperse particulate material that emerges out of magazine subassembly 22'. A touch screen 23' is positioned on support base 12' on either a front wall (shown) or a side wall to provide a computer-implemented interface to control the apparatus functions. It should be understood that the control panel could be operated via remote control or have the touch screen placed on a support separate from support base 12' via wired or wireless connection.

Due to the use of vibratory forces to implement the tube packing function, support base 12' may include base feet 26' secured to each corner of bottom end 13'. Base feet 26' may be formed from an elastomeric material such as silicone to provide shock absorption to prevent the transmission of the vibratory forces to any surface upon which the tube packing apparatus is placed. By functionally decoupling the support surface from the main components of apparatus 10, the apparatus should remain stationary on the support surface. Base feet 26' provide the added function of adjusting for any uneven surfaces that may be used to support apparatus 10'.

Tube-filling tower 14' comprises a series of components including a vertically-oriented extrusion tower 42' having a bottom end secured to a back end of a top surface of main mounting plate 16'. A pair of parallel, vertically-oriented linear guide rails 44' are secured to a front surface of extrusion tower 42' and provide a structural means to permit axial translation and functional alignment of the tube filling/packing components of apparatus 10'. A top tower plate 46' is secured to a top end of extrusion tower 42' to function as a z-axis maximum height stop for the tube filling/packing components. Top tower plate 46' further functions as a vibration transmission component that vibrates when the apparatus is activated. This vibration activity facilitates removal of particulate matter from the tube filling/packing components. It should be understood that this secondary function is additive to the primary source of the vibratory force as disclosed in more detail herein. Alternatively, a stop block (not shown) can be secured to extrusion tower 42' to function as a z-axis stop.

Secured within support base 12' proximal a back end of the support base is a stepper motor 50' that permits the incremental movement of the sliding components of the apparatus. A lead screw 52' is secured to step motor 50' and extends axially through a lead screw bore 54' formed in main mounting plate 16' and along a midpoint between linear guide rails 44'. Rotation of lead screw 52' provides the functional means to impart vertical movement of the sliding components of the apparatus. A top end of the lead screw may or may not be anchored to extrusion tower 42'.

A z-axis carriage 56' is secured to lead screw 52' with a threaded nut having threading matched to the threading of the lead screw. Rotation of lead screw 52' causes z-axis carriage 56' to move in an axial direction, either upwardly or downwardly depending upon the direction (clockwise, counter-clockwise) of lead screw rotation. In one direction, rotation of lead screw 52' will cause the z-axis carriage to move upwardly. In the opposite direction, rotation of lead screw 52' will cause the z-axis carriage to move downwardly. Control of the lead screw rotation is accomplished via computer.

To stabilize and align the orientation of z-axis carriage 56' to the stationary components of the apparatus, the z-axis carriage is formed with two parallel guide-rail-receiving slots (not shown) that each conform to the shape of guide rails 44' in cross section. The slots are formed on the back end of the carriage and extend from a bottom surface to a top surface of the carriage. Bearings, such as ball bearings or linear bearings are used to facilitate axial translation of the z-axis carriage along the guide rails.

Secured to each side of z-axis carriage 56' is a dedicated slide track 58'. Each slide track 58' is oriented vertically with opposing sidewalls and an optional v-groove or other geometric-shaped groove formed down a vertical centerline of the slide track. The v-groove provides lateral alignment for other vibratory components of the apparatus described in more detail herein.

Secured to a top surface of z-axis carriage 56' is a magnet assembly mounting plate 60'. Mounting plate 60' provides a stable, planar surface to mount an electromagnetic vibration subassembly 62' that includes an electromagnet 64' connected to a power source. In one embodiment, suspended about electromagnet 64' within the flux range of the electromagnet is a magnetic conductor 66' in the form of an angle iron. A first angle-iron edge 68' of magnetic conductor 66' is attached to first ends of a pair of vibration-decoupling springs 68'. Second ends of the springs are attached to z-axis carriage 56'. A second angle-iron edge 70' of magnetic conductor 66' is secured to a slide carriage 72'. Magnetic conductor 66' functions as a magnetic conductor attracted to magnetic flux emitted by activation of electromagnet 64'. In an alternative embodiment, a planar magnetic conductor 66" is oriented horizontally or orthogonal to the vertical axis of the apparatus and a back surface of slide carriage 72' is secured to a front edge of magnetic conductor plate 66".

Slide carriage 72' is a vertically-oriented mounting plate structured and dimensioned to receive and support a hopper assembly 74' described in more detail herein. A top slide-carriage end 76' is secured to second angle-iron edge 70' and is essentially suspended from the magnetic conductor 66'. Extending laterally from a back side of slide carriage 72' are a pair of spaced slide wheel axles 78'. Secured to each axle is a slide wheel 80' that rotates about the axle. Perimeter edges of each slide wheel 80' registers against and rotates along a slide track 58' within the v-groove that provides positive lateral alignment during operation of the apparatus. Cooperation between slide wheels 80' and slide tracks 58' ensure proper omnidirectional alignment of slide carriage 72' relative to the fixed components of the apparatus during operation. As with the first disclosed embodiment, omnidirectional alignment is of significant importance to this second embodiment since the apparatus is being used to fill illustratively paper tubes having circular cross-sections. With this configuration, the only axis subject to variation is the z-axis. This ensures continual static alignment along the x and y axes during operation. It should be understood that multiple pairs of slide wheels can be connected via axles to slide carriage 72' and rotate within the confines of slide tracks 58' to improve the omnidirectional alignment.

A pair of standoff springs 82' constructed in axial tension are secured between electromagnet 64' and magnetic conductor 66' to maintain a precise gap between the electromagnet and magnetic conductor to optimize the vibratory response to electromagnetic activation. Springs in axial compression also may be used for this purpose. The combination of standoff springs 82' and decoupling springs 68' provide vibratory isolation of the slide carriage/hopper assembly from the static components of the apparatus.

Figure 22:
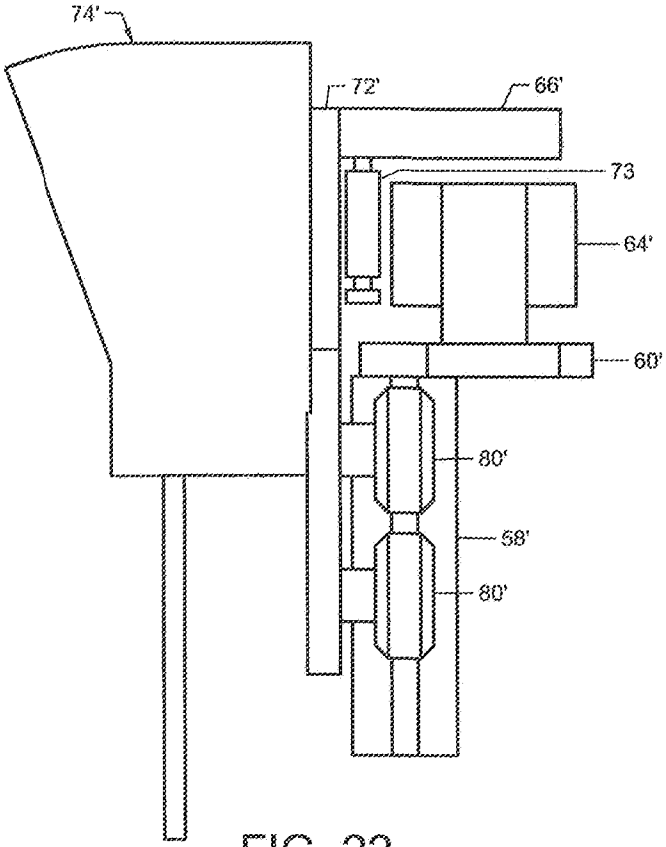
FIG. 22 is a sectional, side view in elevation of a vibration emitting element of the packing tube apparatus shown in FIG. 10.
Figure 23:
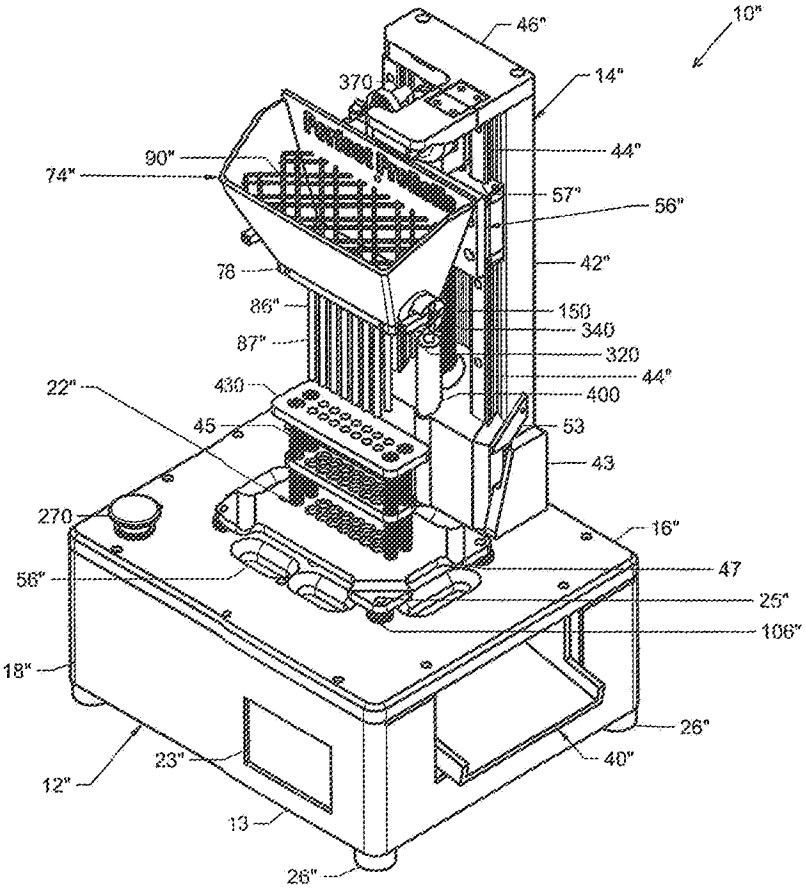
FIG. 23 is a top, side perspective view of a packing tube apparatus according to another embodiment of the disclosure.
Figures 24, 25, 26, 27, 28, 29, 30:
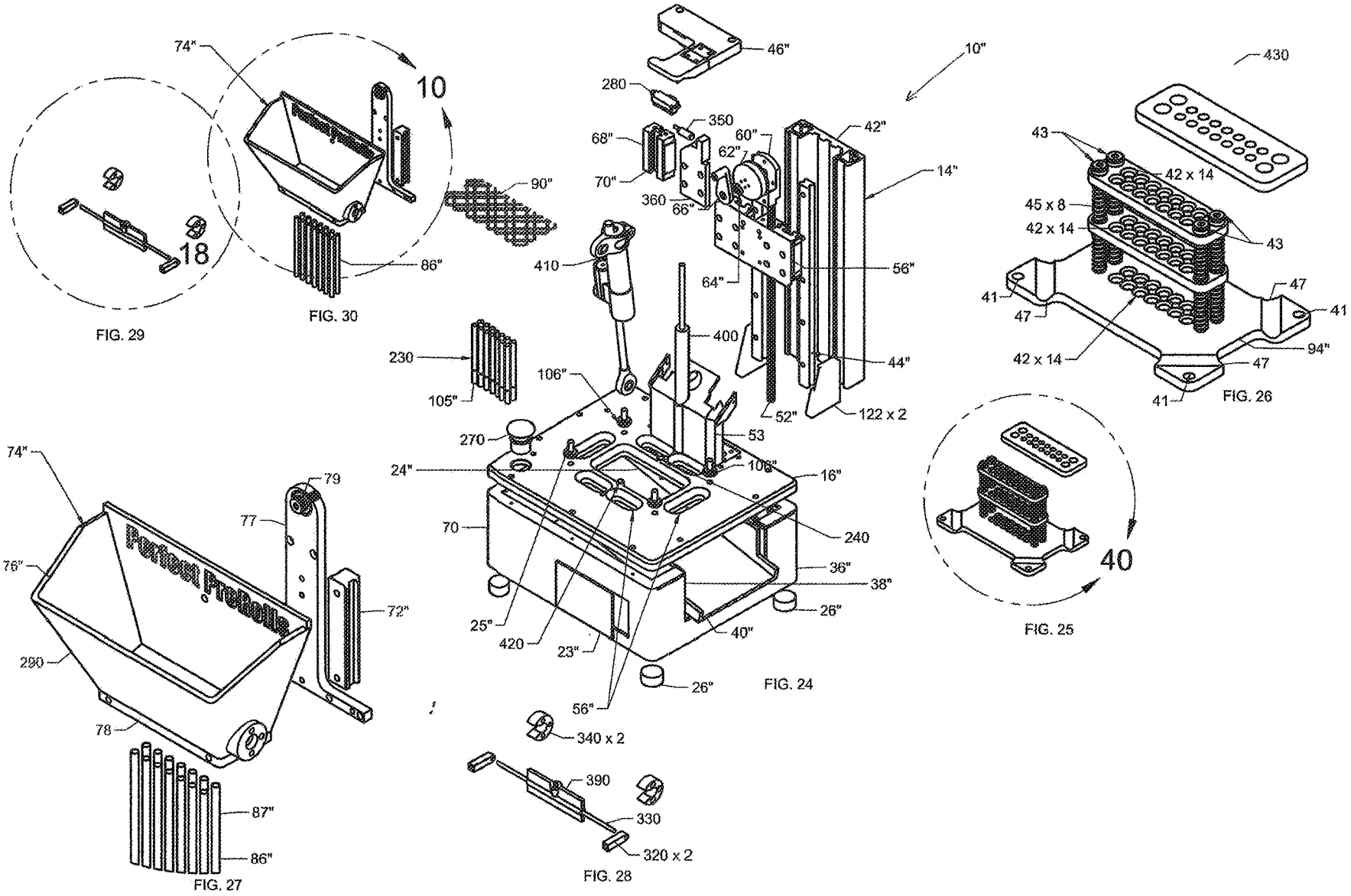
FIG. 24 is an exploded view of the packing tube apparatus according to the embodiment of the disclosure shown in FIG. 23.
FIG. 25 is a cut-away exploded view of a magazine support plate subassembly according to the embodiment of the disclosure shown in FIG. 23.
FIG. 26 is an exploded view of a magazine support plate subassembly according to the embodiment of the disclosure shown in FIG. 23.
FIG. 27 is an exploded view of a hopper subassembly according to the embodiment of the disclosure shown in FIG. 23.
FIG. 28 is an exploded view of a mixing flap subassembly according to the embodiment of the disclosure shown in FIG. 23.
FIG. 29 is a cut-away exploded view of a mixing flap subassembly according to the embodiment of the disclosure shown in FIG. 23.
FIG. 30 is a cut-away exploded view of a hopper subassembly according to the embodiment of the disclosure shown in FIG. 23.
Figure 31:
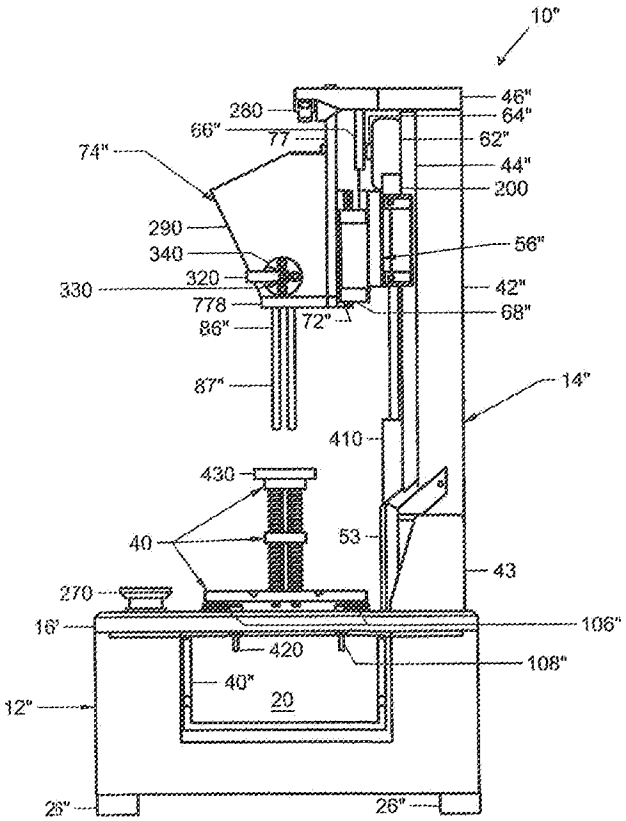
FIG. 31 is a right-side view in elevation of the packing tube apparatus shown in FIG. 23.
Figure 32:
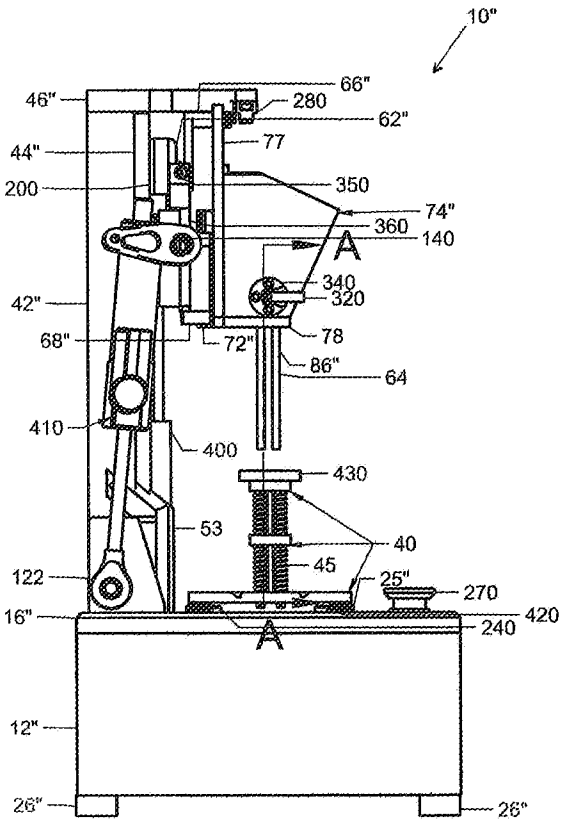
FIG. 32 is a left-side view in elevation of the packing tube apparatus shown in FIG. 23.
Figure 33:
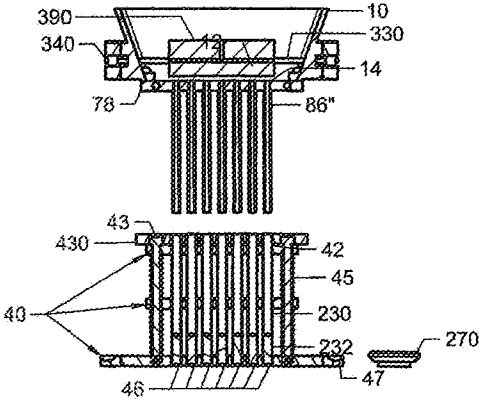
FIG. 33 is a front sectional view of a hopper/tube/tube magazine subassembly according to the embodiment of the disclosure shown in FIG. 23.
Figure 35:
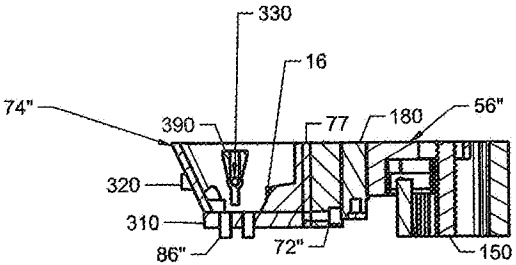
FIG. 35 is a side sectional view of a z-axis carriage/hopper subassembly according to the embodiment of the disclosure shown in FIG. 23.
Figure 34:
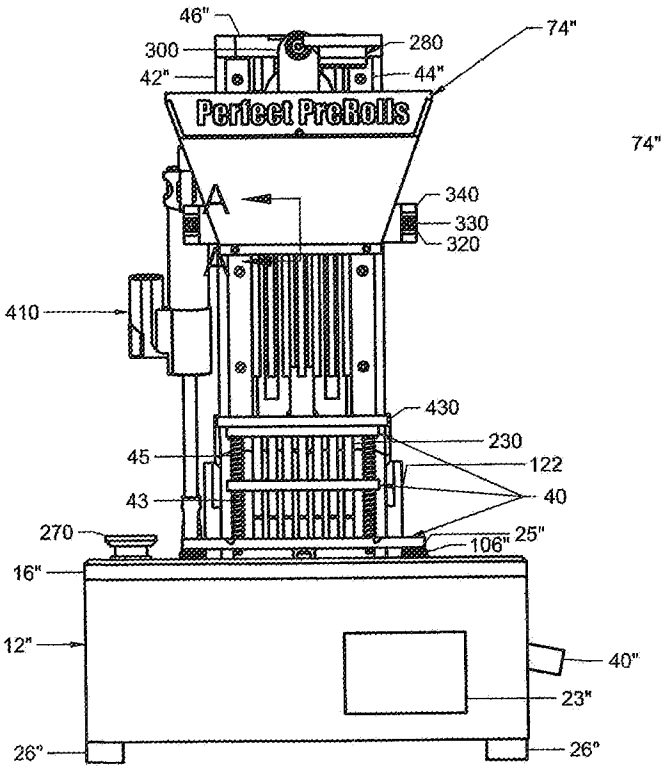
FIG. 34 is a front view in elevation of the packing tube apparatus shown in FIG. 23.
Figure 36:
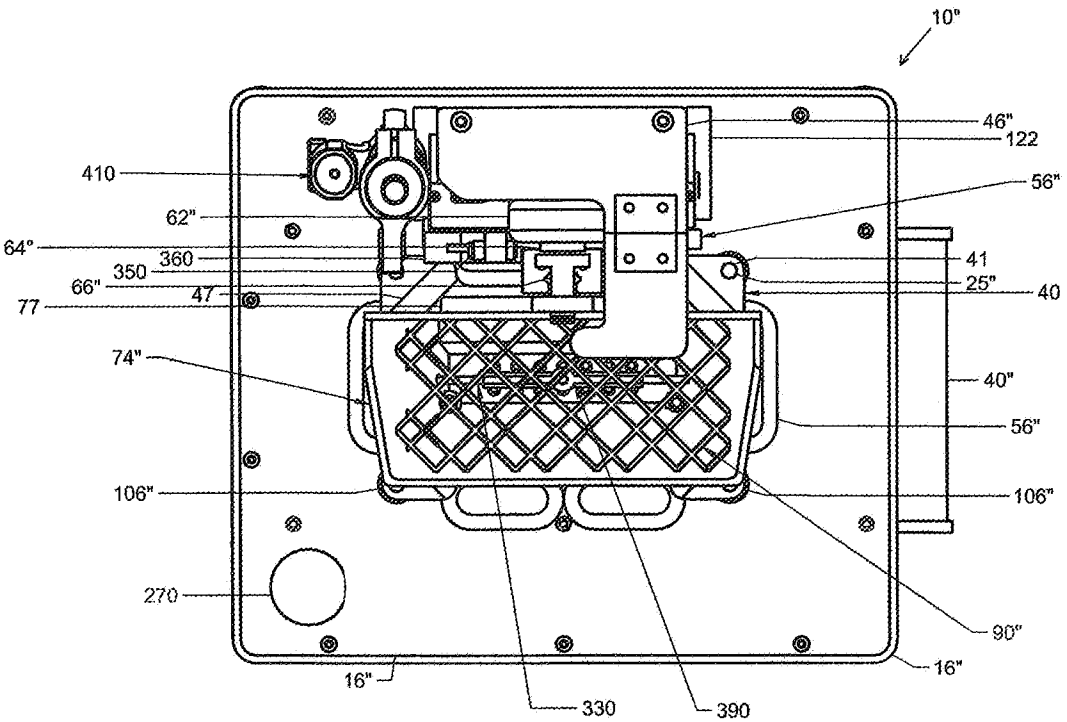
FIG. 36 is a top view of the tube packing apparatus shown in FIG. 23.

As shown in FIG. 22, suspended from magnetic conductor 66' via bolts 71 are a pair of chatter weights 73. Chatter weights 73 have a central through-bore dimensioned to receive bolts 71 and permit the free vertical translation of the chatter weights along the bolts. When hopper 74' vibrates due to the activation of electromagnet 64', the oscillation rhythm imparted to the hopper is disrupted by the weights 73 that "chatter" during the vibration events. The disruption of the oscillation events helps to prevent particulate matter buildup and helps to deposit the particulate matter in a more uniformly dense manner. Chatter weights 73 are essentially free-floating weights that take the smoothness out of the vibration by creating an oscillation disturbance to the periodicity of the oscillation movement. Chattering interferes or interrupts the vibration events. This vibrational disturbance, which can be asymmetrical, has shown the surprising, unexpected effect of keeping particulate material from building up and "sticking" before being deposited in packing tubes 86' described in more detail herein.

Secured to a front face of slide carriage 72' is hopper assembly 74'. Hopper assembly 74' has four walls that may or may not be sloped inwardly toward a bottom end formed with a plurality of tube bores 84' arranged is a grid pattern if multiple rows or in a line pattern if configured in a single row. It should be understood that using sloped walls may lead to undesirable concentration of the particulate material at the bottom of the hopper. Secured within each tube bore is a vertically-oriented, elongate particulate delivery and packing tube 86'. Each tube provides a precise vertical pathway for particulate material to be deposited in cylindrically-shaped papers or like-shaped objects. The cross-sectional diameters or geometric shapes of the packing tubes are set to slide within elongate containers having cylindrical or other cross-sectional geometric shapes such as cylindrical papers secured in the apparatus. The outer surfaces of the packing tubes should not register against and slide along the inner surfaces of the cylindrical papers. Rather, the packing tubes should slide proximal to the inner surfaces. Leading edges of each packing tube 86' provide a means to compress particulate material deposited in the cylindrical papers as disclosed in more detail herein. An optional qualifying screen 90' may be secured in hopper assembly 74' to filter particulate material based upon size.

Each tube bore 84' is formed with a counterbore 88' having a shallow-sloped bottom annular surface that promotes migration of particulate material into packing tube 86'. Use of a counterbore provides readily available particulate material for transfer through the packing tube without all the weight of the particulate material in the hopper bearing on the single packing tube and tube bore. In an alternative embodiment, each packing tube 86' is positioned in each tube bore 84' with a top end extending above the bottom surface of hopper assembly 74'. This further prevents clogging of the packing tubes by removing the tube top ends from the particulate material at the very bottom of the hopper that may be compressed from the weight of the particulate material in the hopper assembly.

In an alternative embodiment, the top ends of each packing tube 86' is positioned proud of the bottom inner surface of hopper assembly 74'. This helps to prevent particulate material compressed against the bottom of the hopper from clogging the packing tubes. Surprisingly, with the top ends of the packing tubes extended above the bottom of the hopper, particulate material at the bottom of the hopper assembly finds its way into the packing tubes due to the vibrational forces imparted on the hopper assembly. To further aid in the deposit of particulate material, a mixer 75 that has several spaced tines is placed in the hopper where the mixer resonates when vibrational energy is activated and helps to keep the particulate material mixed, separated and moving.

A paper-holding magazine subassembly 22' includes a substantially flat surface plate 94' having locator bores 27 formed proximal each corner of plate 94'. Locator bores 27 are dimensioned to fit over locator pins 25 to provide alignment along x and y axes and to vertically align the magazine subassembly with the hopper assembly 74'. Formed in surface plate 94' are a series of elongate container alignment bores 95. The number and location of the alignment bores correspond to the number and location of packing tubes 86 and are dimensioned to receive the bottom ends of the elongate containers. In one embodiment, the sides of surface plate 94' are recessed or cut away to expose drain holes or drain chutes 34 positioned to receive particulate matter that spills out of packing tubes 86' and the elongate containers. Drain chutes 34 are positioned above catch tray 40 and direct stray particulate material onto the catch tray. Magazine handles 33 are secured to opposing lateral ends of surface plate 94' to facilitate manual manipulation of magazine assembly 22'.

Magazine subassembly 22' has a series of shoulder bolts 29 extending vertically from surface plate 94. Each shoulder bolt is positioned at one of the corners of the surface plate and each supports layered magazine springs and alignment plates that collectively align elongate containers positioned in the magazine subassembly. More particularly, a first set of magazine springs 31 in axial tension are placed onto each of the shoulder bolts 29. A first alignment plate 35 is formed with a series of through-bores 37 dimensioned and aligned with the alignment bores 95. First plate bores 39 are formed at each corner of first alignment plate 35 and are dimensioned to receive a shoulder bolt 29. When assembled to the shoulder bolts 29, a bottom surface of first alignment plate 35 registers against to the top ends of magazine springs 31.

After first alignment plate 35 has been positioned onto the shoulder bolts, a second set of magazine springs 41, also in axial tension, are secured over the shoulder bolts 29. Thereafter, a second alignment plate 43 is secured onto shoulder bolts 29 and registered against the top ends of second magazine springs 41. Second alignment plate 43 is formed with second alignment bores 45 dimensioned and aligned with the alignment bores 95. Alignment bores 37 and 45 are arranged in a grid or line pattern set to perfectly match the grid or line arrangement of the packing tubes 86. Shoulder bolts 29 are secured in threaded bores in surface plate 94. Top ends of the second alignment bores 45 are formed with chamfers 102 to ease the insertion of elongate containers.

Springs 31 and 45 allow the alignment plates to collapse and return to their preload orientation. By collapsing the alignment plates, filled elongate containers can be more easily removed from magazine subassembly 22'. The dimensional tolerances of the alignment bores 95, 37 and 45 are set to receive the elongate containers in a tight tolerance arrangement. It should be understood that the number of packing tubes and tube bores is scalable. It also should be understood that the use of a modular magazine permits the rapid filling of cylindrical papers by using multiple magazines. When one magazine has been completely processed, the magazine can be removed and replaced with another magazine loaded with unfilled cylindrical papers.

Formed at the bottom of each alignment bore 95 is a reduced-diameter drain hole 100'. Drain holes 100' are defined illustratively by annular paper tube shoulders that function as a stop for the paper tubes if cylindrical elongate containers are used. Other drain hole shapes and shoulders can be dimensioned to accommodate elongate containers with other than circular cross-sections. The drain holes permit particulate material not compressed in the paper tubes to exit the paper tubes into the drain chutes 34' and catch tray 40' for collection and reuse.

Secured to a top surface of base plate 16' are floor springs 17. Top ends of floor springs 17 register against a bottom surface of surface plate 94' and function to isolate magazine assembly 22' from the vibrational forces imparted by apparatus 10'.

Figure 20:
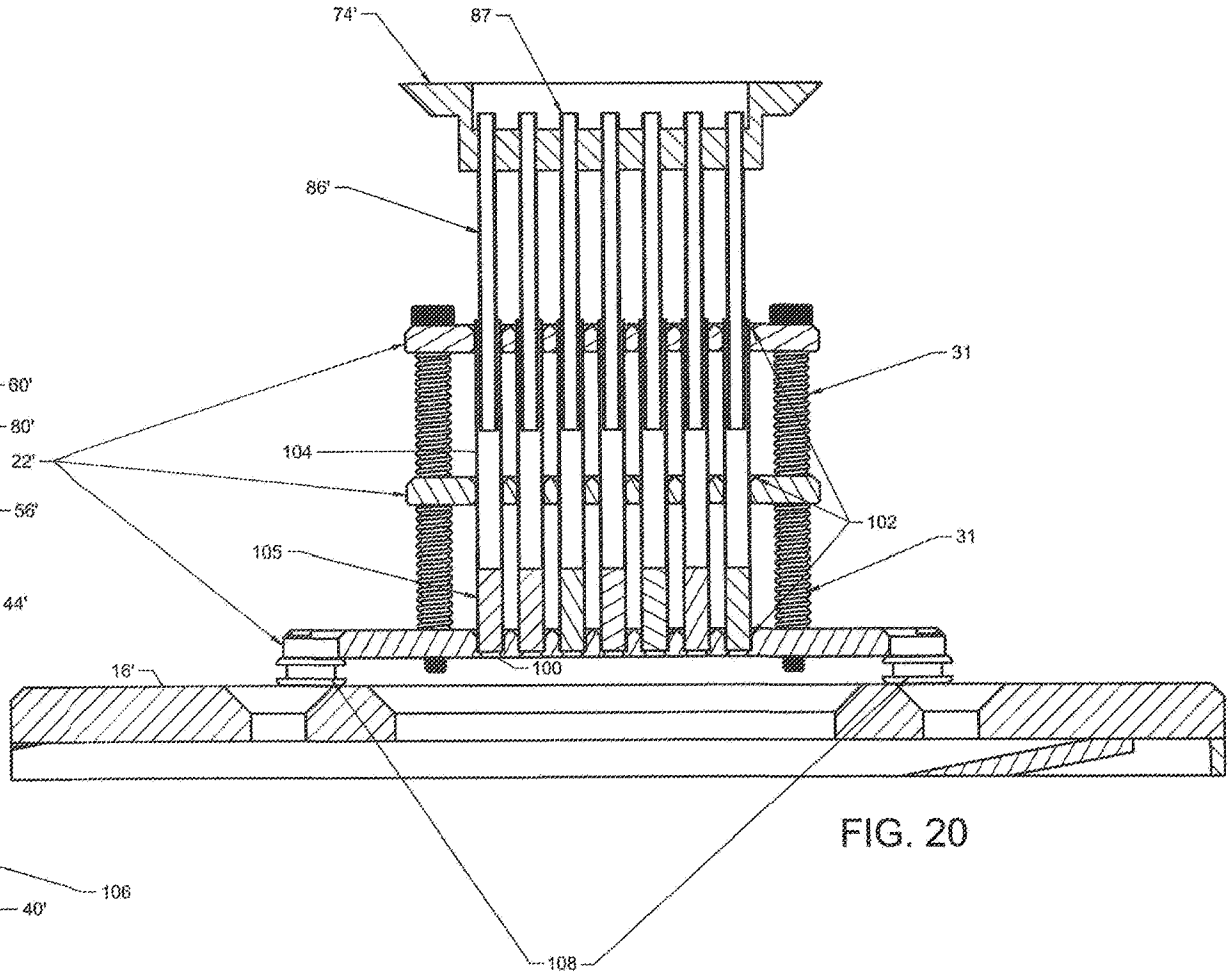
FIG. 20 is a sectional view in elevation of a magazine subassembly and a hopper/packing tube assembly with packing tubes inserted into elongate containers secured in magazine tube bores according to the embodiment of the disclosure shown in FIG. 10.
Figure 19:
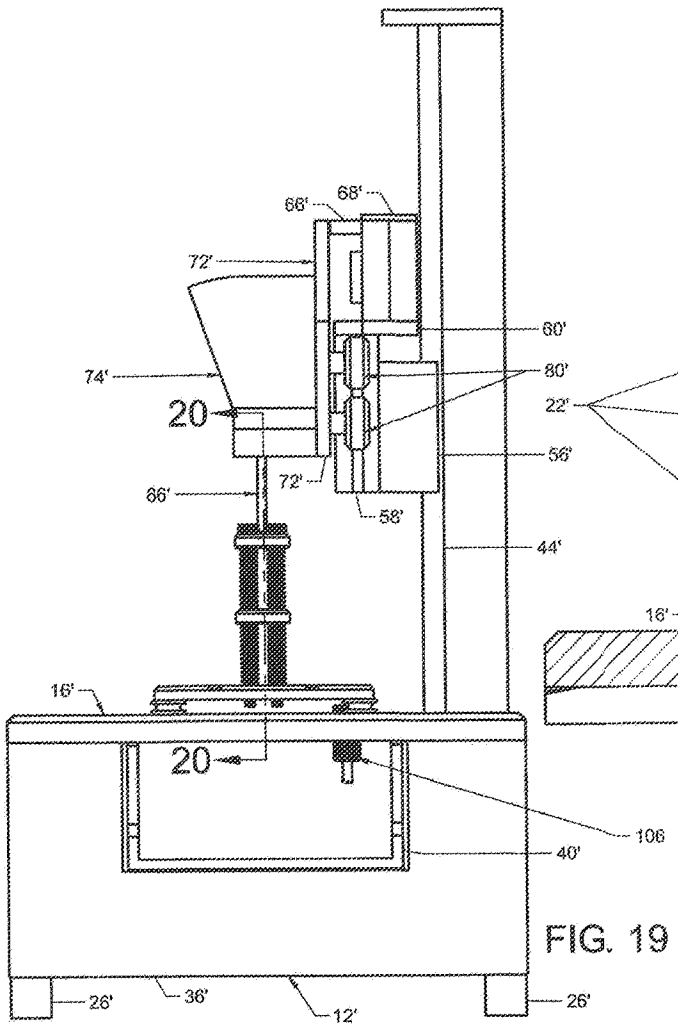
FIG. 19 is a side view in elevation of the tube packing apparatus shown in FIG. 10.
Figure 21:
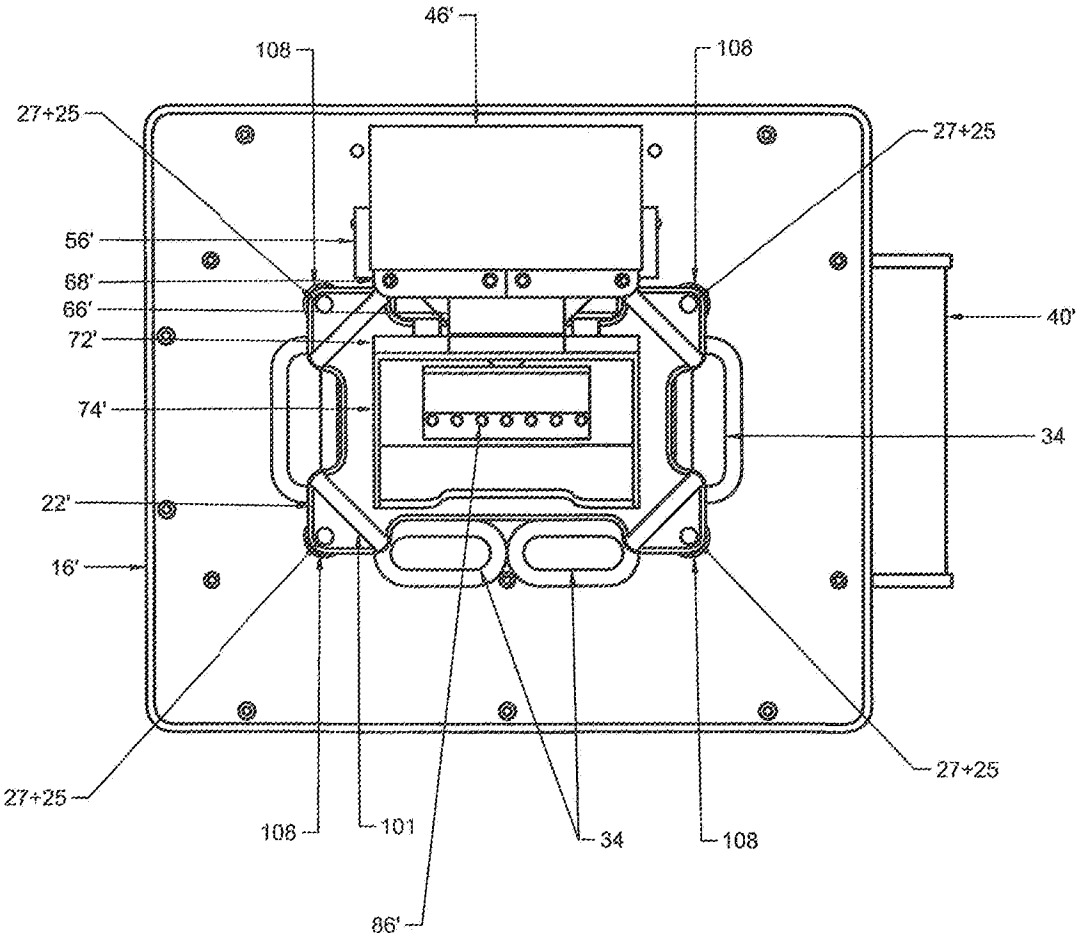
FIG. 21 is a top view of the packing tube apparatus shown in FIG. 10.

In an alternative embodiment, as shown in FIGS. 19-21, in place of load cells, proximity sensor(s) 108 may be used to detect downward movement of magazine subassembly 22'. In this embodiment, elastomeric cushions 106 that may be in the form of grommets or springs are placed over locator pins 25 to enable magazine subassembly 22' to be compressed downwardly by packing tubes 86. In the embodiment shown, elongate containers 104 having filters 105 are loaded into magazine subassembly 22'. When the filing process in complete, downward pressure exerted on the elongate containers 104 by packing tubes 86' is transferred to magazine subassembly 22' that forces the magazine subassembly downwardly. Elastomeric cushions 106 permit the downward motion. When magazine subassembly 22' is lowered to a preselected distance from proximity sensor 108, a signal is sent to the microprocessor to identify the spatial location of the packing tubes 86' (relative to the filter at the bottom of the elongate containers) to begin the filling process. This enables the removal of the completed elongate containers from magazine subassembly 22' or the exchange of the filled magazine with an unfilled magazine loaded with elongate containers.

Having described the structural features of the second embodiment of the tube packing apparatus, an exemplary explanation of the method of packing paper tubes with particulate material is provided. It should be understood that the method steps described herein do not necessarily have to be performed in the order described. To commence the tube-packing function, magazine subassembly 22' is filled with paper tubes. The filling function can be performed with the magazine subassembly assembled to the apparatus or maintained separate from the apparatus. With the magazine subassembly filled with paper tubes and positioned in apparatus 10', hopper assembly 74' is filled with particulate material. Via computer-implemented activation, stepper motor 50' rotates lead screw 52' to lower the slide carriage/hopper assembly toward magazine subassembly 22'. Once the packing tubes 86' have entered the paper tubes and travel downwardly proximal the bottom end of the paper tubes, electromagnet 66' is energized with AC current to take advantage of the 60 Hertz cycling that caused the electromagnet to emit pulsating flux lines. The fluctuating flux lines cause magnetic conductor 64' to vibrate. The vibratory force is transferred to slide carriage 72' and hopper assembly 74'. This force also is applied to the particulate material that flows downwardly via gravitational force and vibratory agitation and deposits in the paper tubes. As the vibration force is applied, step motor 50' creates a z-axis oscillation that causes the leading edges of packing tubes 86' to compress and pack particulate material in the paper tubes below the packing tube leading edges.

The compression effect can be applied in a linear or variable frequency approach. As the slide carriage/hopper assembly is incrementally retracted to further fill the cylindrical papers, the constantly-applied vertical oscillating motion of the packing tubes has the effect of depositing particulate material in a vertical ascending manner with a compression function being applied to the particulate material most recently deposited. This ensures uniform density of the particulate material column formed in the paper tube. Once the packing tubes have been fully retracted from magazine subassembly 22', the slide carriage/hopper assembly can be fully retracted for the next round of tube packing.

One significant advantage of the computer-implemented tube packing method is the ability to provide variable-rate packing. With each compression event, the particulate material most recently deposited is compressed. The compression event, however, also applies compression to previously deposited layers that have undergone compression events. The lowest layers experience the highest numbers of compression events. Due to the buildup of compression events, the need for constant-rate compression events diminishes with each compression event. To adjust for this, the compression rate can be made variable with the highest rate applied at the beginning of the particulate deposit function and a reduced rate applied as the deposit function approaches the fully-filled condition. This further ensures uniform density of the particulate material throughout the particulate column formed in the cylindrical papers.

Referring now to FIGS. 23-35, in another aspect of the disclosure, a tube packing apparatus, designated generally as 10", includes many of the features disclosed with respect to tube packing apparatuses, 10 and 10'. To improve the functionality of the hopper/magazine interaction, several different features are incorporated into or substituted for elements of the foundational design to improve the consistency, repeatability and reliability of multiple paper loading cycles. To that end, tube packing apparatus 10" includes a hopper assembly 74" with a mixing flap 390 with offset counterweights 320 that create a mixing motion with flap bumpers that provide a soft impact when it comes into registration with hopper 74".

As shown, tube packing apparatus 10", includes broadly a magazine support base assembly, designated generally as 12", and a tube-filling or extrusion tower 14". Magazine support base assembly 12" is a cube-shaped hollow structure that houses several elements of tube packing apparatus 10" including a paper-holding or elongate-container-holding magazine assembly disclosed in more detail herein. Tube-filling tower 14" includes a hopper/filling-packing tube subassembly and linear rails disclosed in more detail herein.

Magazine support base assembly 12" has a main mounting plate 16" secured to the top ends of support base walls 18" that combined with a bottom end 13" to define a chamber 20" to receive a magazine subassembly 22". Portions of main mounting plate 16" define an opening 24" dimensioned to receive magazine subassembly 22". In one embodiment, opening 24" is substantially rectangularly-shaped. It should be understood that the overall shape of opening 24" can take on any regular or irregular shape and remain within the scope of the disclosure. One or more drain chutes 56" are positioned about opening 24" to direct any particulate material that falls out of the magazine assembly to fall ultimately onto catch tray 40" disclosed in more detail below. A plurality of locator pins 25" are set into, or formed on, main mounting plate 16" outside the corners of opening 24" (for a square or rectangular shaped opening). Locator pins 25" function to align magazine subassembly 22" to other components of the tube packing apparatus as disclosed in more detail herein.

Set about each locator pin 25" and registered against a top surface of main mounting plate 16" is a floor spring/grommet 106". Floor springs/grommets 106" perform multiple functions. One function is to isolate magazine subassembly 22" from vibrations. Due to the compressibility of the springs/grommets, a second function is to permit axial movement of magazine subassembly 22" (on the order of 1 or more millimeters), when placed under an axial load provided by the forced downward motion of filling tubes 86" applied against elongate containers 104" secured in magazine subassembly 22". The axial movement of magazine subassembly 22" is detected by proximity sensor(s) 108", disclosed in more detail below, that enables the apparatus programming to determine the spatial orientation of the interacting components. By limiting the axial travel of the magazine subassembly to a relatively small distance as disclosed above, magazine subassembly 22' remains aligned to ensure filling tubes 86" remain aligned with elongate containers 104" and/or filters 105", if present in the elongate containers. A yet further function of floor springs/grommets 106" is to help average out the end results of a filling operation via the incremental axial movement of magazine subassembly 22".

Positioned through and below main mounting plate 16" is proximity sensor(s) 108" that detects the axial orientation of magazine subassembly 22" relative to the horizontal plane occupied by main mounting plate 16", and more particularly, detects forces, particularly downward forces, applied to magazine assembly 22". Proximity sensor(s) 108" actively detects downward force/weight generated throughout the tube packing process performed by apparatus 10". The force readings, derived from the filling tubes 86" register against, and exert force on, filters 105", are sent to a processing unit (not shown) that processes the force data with respect to algorithms programmed into the computer-controlled apparatus. If no filters 105" are present during axial translation of filling tubes 86", the filling tubes will register against and apply a force to, magazine base plate 94" described in more detail hereinbelow.

Also positioned through and below and secured to main mounting plate 16" is magazine detector 420. Magazine detector 420 is another proximity sensor that detects the presence of magazine subassembly 22". Detection of the presence of a magazine subassembly is sent to the processing unit to ensure processing steps are not taken without a magazine subassembly being loaded onto apparatus 10".

Positioned within magazine support base assembly 12", proximal to bottom end 13" and under opening 24" is an angled catch tray 40" dimensioned to catch any particulate matter escaping magazine subassembly 22" and falling through drain chute(s) 56". A side wall 36" of magazine support base assembly 12" has portions defining a catch tray opening 38" the base of which is the distal end of drain chute 40". Drain chute 40" functions as a particulate retrieval device to facilitate the organized collection and removal of any disperse particulate material that emerges out of magazine subassembly 22". A touch screen 23" is positioned on magazine support base assembly 12" on either a front wall or a side wall to provide a computer-implemented interface to control the apparatus functions. It should be understood that the control panel could be operated via remote control or have the touch screen placed on a support separate from magazine support base assembly 12" via wired or wireless connection.

Due to the use of vibratory forces to implement the tube packing function, support base assembly 12" may include base feet 26" secured to each corner of bottom end 13". Base feet 26" may be formed from an elastomeric material such as silicone to provide shock absorption to prevent the transmission of the vibratory forces to any surface upon which the tube packing apparatus is placed. By functionally decoupling the support surface from the main components of apparatus 10", the apparatus should remain stationary on the support surface. Base feet 26" provide the added function of adjusting for any uneven surfaces that may be used to support apparatus 10".

Tube-filling tower 14" comprises a series of components including a vertically-oriented extrusion tower 42" having a bottom end secured to a back end of a top surface of main mounting plate 16". Optional tower stiffeners 43 may be secured to the side, bottom ends of extrusion tower 42" and secured to main mounting plate 16" to rigidify the connection between the extrusion tower and main mounting plate. A pair of parallel, vertically-oriented linear guide rails 44" are secured to a front surface of extrusion tower 42" and provide a structural means to permit axial translation and functional alignment of the tube filling/packing components of apparatus 10". A top tower plate 46" is secured to a top end of extrusion tower 42" to function as a z-axis maximum height stop for the tube filling/packing components. Top tower plate 46" further functions as a solid surface against which the hopper vibrates, disrupting the smooth sine wave of the vibration. This disruption facilitates removal of particulate matter, i.e., undoes any clogging, from the tube filling/packing components. It should be understood that this secondary function is additive to the primary source of the vibratory force as disclosed in more detail herein. Alternatively, a stop block (not shown) can be secured to extrusion tower 42" to function as a z-axis stop.

Secured within support base 12" proximal a back end of the support base is a stepper motor 50" that permits the incremental movement of the sliding components of the apparatus. A lead screw 52" is secured to stepper motor 50" and extends axially through a lead screw bore 54" formed in main mounting plate 16" and along a midpoint between linear guide rails 44". Rotation of lead screw 52" provides the functional means to impart vertical movement of the sliding components of the apparatus. A top end of the lead screw may or may not be anchored to extrusion tower 42". A lead screw dust cover 53 secured about lead screw 52' and secured to a top of main mounting plate 16" protects the lead screw and stepper motor 50" from dust and debris from the environment and from the operation of apparatus 10".

A z-axis carriage 56" is secured to lead screw 52" with a threaded nut having threading matched to the threading of the lead screw. Rotation of lead screw 52" causes z-axis carriage 56" to move in an axial direction, either upwardly or downwardly depending upon the direction of lead screw rotation. In one direction, rotation of lead screw 52" will cause the z-axis carriage to move upwardly. In the opposite direction, rotation of lead screw 52" will cause the z-axis carriage to move downwardly. Control of the lead screw rotation is accomplished via computer and associated computer-implemented algorithm(s).

To stabilize and align the orientation of z-axis carriage 56" to the stationary components of the apparatus, the z-axis carriage is formed with two parallel guide-rail-receiving slots 57" that each conform to the shape of guide rails 44" in cross section. The slots are formed on the back end of the carriage and extend from a bottom surface to a top surface of the carriage. Bearings, such as ball bearings or linear bearings secured to the z-axis carriage, are used to facilitate axial translation of the z-axis carriage along the guide rails.

Secured to each side of z-axis carriage 56" is a dedicated slide track 58". Each slide track 58" is oriented vertically with opposing sidewalls and a v-groove formed down a centerline of the slide track. The v-groove provides lateral alignment for other vibratory components of the apparatus described in more detail herein.

Secured to a top surface of z-axis carriage 56" is a motor mounting plate 60". Mounting plate 60" provides a stable, planar surface to mount a vibration motor 62" connected to a power source. Secured to the face of vibration motor 62" is an offset plate 64" that has a post with an internally threaded bore extending outwardly from the face of the offset plate and offset from a center point of offset plate 64". Secured to a distal end of the post via a threaded bolt is a connecting rod assembly 66" that has a proximal end formed with a bore to receive the threaded bolt and a distal end formed with a connecting rod shaft 67 in the form of a second threaded bolt that extends toward the front of apparatus 10". Rotation of the vibration motor results in the connecting rod assembly to move in a circular pattern at a proximal end that translates into a vertical motion at a distal end and linear vibration of the hopper assembly 74" as disclosed in more detail hereinbelow.

A vibration carriage 68" is secured to a front face of z-axis carriage 56". Vibration carriage 68" is an axially elongate component that defines an axially-oriented vibration guiderail slot 70" formed on a front face of vibration carriage 68". Slot 70" is dimensioned to receive a vibration guide rail 72" secured to the hopper assembly 74" via an intermediary component.

Hopper assembly 74" is modular to permit different hoppers to be used with differently sized elongate containers. Hopper assembly 74" includes container 76" that has four walls that may be straight or one or more sloped inwardly toward a bottom end. An axially elongate back plate 77 is secured to a back end of container 76" and provides a rigid support for the container. Back plate 77 further provides a means to connect the container to other structures. A floor plate 78 is registered against a bottom surface of the bottom end of container 76" and is secured to a bottom end of back plate 77. Floor plate 78 is formed with a plurality of tube bores 84" arranged is a grid pattern if multiple rows or in a line pattern if configured in a single row.

Secured within each tube bore is a vertically-oriented, elongate particulate delivery and packing tube 86". Each tube provides a precise vertical pathway for particulate material to be deposited in cylindrically-shaped papers or like-shaped objects. The cross-sectional diameters of the packing tubes are set to slide within cylindrical papers secured in the apparatus. The outer surfaces of the packing tubes may or may not register against and slide along the inner surfaces of the cylindrical papers. No to minimal contact has shown to produce the best product. Leading edges of each packing tube 86" provide a means to compress particulate material deposited in the cylindrical papers as disclosed in more detail herein. An optional qualifying screen 90" may be secured in hopper assembly 74" to filter particulate material based upon size.

In an alternative embodiment, each packing tube 86" may be formed with flared or flanged leading end that improves the packing function. Use of a flanged end creates a larger packing surface area and should help to prevent or control clogging. It should be understood that the flange diameter must be less than the inside diameter of the elongate containers.

Each tube bore 84" is formed with a counterbore 88" having a shallow-sloped bottom annular surface that promotes migration of particulate material into packing tube 86". Use of a counterbore provides readily available particulate material for transfer through the packing tube without all the weight of the particulate material in the hopper bearing on the single packing tube and tube bore. In an alternative embodiment, each packing tube 86" is positioned in each tube bore 84" with a top end extending above the bottom surface of hopper assembly 74". This further prevents clogging of the packing tubes by removing the tube top ends from the particulate material at the very bottom of the hopper that may be compressed from the weight of the particulate material in the hopper assembly.

A top end of back plate 77 is formed with a bearing 79 dimensioned to receive the second bolt of connecting rod assembly 66" and permits rotational movement of the bearing relative to back plate 77. When vibration motor 62" is activated, connecting rod assembly 66" imparts a vertical motion on hopper assembly 74". Vertical motion of hopper assembly 74" results in vibration guide rail 72" to translate vertically within vibration guiderail slot 70".

Bottom sides of container 76" are formed with bores to receive a flapper axle 330 that rotates within the bores. Counterweights 320 are secured to each end of flapper axle 330 with the attachment point of each weight secured to the axle at an end of each counter weight 320. Flap bumpers 340 are secured to axle 330 each adjacent to a counterweight 320 and provide a soft impact and restrict the range of motion of the counterweights. A mixing flap 390 is secured to flapper axle 330 at the approximate center of the axle within the volume of container 76". When vibration energy is applied to hopper assembly 74", counterweights 320 begin to rotate about axle 330 due to the asymmetric connection to the axle. As the counterweights rotate, mixing flap 390 rotates and contacts the granular particulates inside container 76" to stir, mix and break up and clumps of particulate material.

To take some pressure off lead screw 52", a gas strut 400 is secured to main base plate 16" at one end and to a bottom end of z-axis carriage 56". The force exerted on lead screw 52" when the z-axis carriage moves in a downward direction is dampened by gas strut 400.

To prevent the transfer of the vibrational energy to lead screw 52", a dampener 410 is secured at one end to tower stiffener 43 and to z-axis carriage 56" at a second end. Operation of vibration motor 62" imparts vibrational energy to the entire apparatus 10". Dampener 410 absorbs the vibrational energy and prevents it from travelling to other components of apparatus 10" other than hopper assembly 74".

Secured to a top end of tube-filling tower 14" or a bottom of top tower plate 46" is a Top Dead Center proximity sensor mounting plate 360. Secured to mounting plate 360 is a Top Dead Center proximity sensor 350 positioned to sense the presence of a bolt on vibration motor 62" that indicates the vibration stroke is at top dead center. This information is transferred to the processor for application in the algorithm.

To ensure there is sufficient particulate matter in container 76", a level sensor 280 is secured to a bottom surface of top tower plate 46". Sensor 280 detects the particulate level in the container and transfers the information to the processor for application to the algorithm. In the event the apparatus' function has to be terminated quickly, an emergency stop 270 is secured to a corner of main base plate 16" and enables the user to shut the apparatus down with the press of the emergency stop.

Paper-holding magazine subassembly 22" includes a substantially flat surface plate 94" having locator holes 96" extending axially below each corner of plate 94". Locator holes 96" are dimensioned to fit over locator pins 28" to provide alignment along x and y axes and to vertically align the magazine subassembly with the hopper assembly 74". Magazine subassembly 22" has a main body formed below surface plate 94" with a series of vertically-oriented paper tube bores 98" formed therein and dimensioned to receive cylindrically-shaped papers used to receive particulate material. The paper tube bore arrangement, e.g., a grid or line pattern is set to perfectly match the grid or line arrangement of the packing tubes 86". The cross-sectional diameters of the paper tube bores are set to receive in a tight tolerance arrangement, the paper tubes. It should be understood that the number of packing tubes and tube bores is scalable. It also should be understood that the use of a modular magazine permits the rapid filling of cylindrical papers by using multiple magazines. When one magazine has been completely processed, the magazine can be removed and replaced with another magazine loaded with unfilled cylindrical papers.

Formed at the bottom of each paper tube bore 98" is a reduced-diameter drain hole 100". Drain holes 100" are defined by annular paper tube shoulders that function as a stop for the paper tubes. The drain holes permit particulate material not compressed in the paper tubes to exit the paper tubes into the drain chute 34" for collection and reuse.

Formed at a top end of each paper tube bore 98" is a lead-in chamber 102". Lead-in chamfer 102" facilitates the loading of paper tubes into paper tube bores 98". It should be noted that chamfer 102" does not perform the function of aligning the packing tubes 86" with the tube bores. The packing tubes must be aligned independently of the chamfers and should not contact the top ends of the elongate containers. An optional tube coating 87" can be affixed to the inside and outside surfaces of packing tubes 86" to prevent the buildup of particulate material and potential clogging of the packing tubes.

Having described the structural features of the tube packing apparatus, an exemplary explanation of the method of packing paper tubes with particulate material is provided. It should be understood that the method steps described herein do not necessarily have to be performed in the order described. To commence the tube-packing function, magazine subassembly 22" is filled with paper tubes. The filling function can be performed with the magazine subassembly assembled to the apparatus or maintained separate from the apparatus. With the magazine subassembly filled with paper tubes and positioned in apparatus 10", hopper assembly 74" is filled with particulate material. Via computer-implemented activation, stepper motor 50" rotates lead screw 52" to lower the z-axis carriage/hopper assembly 74" toward magazine subassembly 22". Once the packing tubes 86" have entered the paper tubes and travel downwardly proximal the bottom end of the paper tubes, vibration motor 62" is activated which causes container 76" to vibrate. The vibration causes counterweights 320 to rotate axle flapper axle 330, which, in turn, causes mixing flapper 390 to brush against particulate material in container 76" so as to stir, mix and prevent clumping of the particulate material. The vibratory force is transferred to slide carriage 72 and hopper assembly 74. This force also is applied to the particulate material that flows downwardly via gravitational force and vibratory agitation and deposits in the paper tubes. As the vibration force is applied, step motor 50 creates a z-axis oscillation that causes the leading edges of packing tubes 86 to compress and pack particulate material in the paper tubes below the packing tube leading edges.

The compression effect can be applied in a linear or variable frequency approach. As the z-axis carriage/hopper assembly is incrementally retracted to further fill the cylindrical papers, the constantly-applied vertical oscillating motion of the packing tubes has the effect of depositing particulate material in a vertical ascending manner with a compression function being applied to the particulate material most recently deposited. This ensures uniform density of the particulate material column formed in the paper tube. Once the packing tubes have been fully retracted from magazine subassembly 22", the slide carriage/hopper assembly can be fully retracted for the next round of tube packing.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What we claim as new and desire to secure by United States Letters Patent is:

1. A particulate material delivery and packing apparatus comprising:

a magazine support base that defines a magazine support base chamber that houses computer elements, wherein the magazine support base comprises a main mounting plate with portions defining an opening and a lead screw bore;

an extrusion tower secured to the main mounting plate;

a pair of linear guides secured to the extrusion tower;

a motor secured in the magazine support base chamber;

a vertically-oriented lead screw secured to the motor, wherein the lead screw passes through the lead screw bore and can rotate freely within the lead screw bore;

a z-axis carriage secured to the linear guides and rotatably secured to the lead screw, wherein the z-axis carriage can move vertically along the linear guides via rotation of the lead screw;

a hopper assembly with a plurality of spaced, downwardly-extending filling/packing tubes secured to the z-axis carriage;

an electromagnet vibration subassembly secured to the z-axis carriage; and, a magnetic conductor secured to the z-axis carriage and the hopper assembly.

2. The particulate material delivery and packing apparatus of claim 1 further comprising a paper-holding magazine subassembly having a surface plate with a plurality of locator bores and container alignment bores formed in the surface plate and a plurality of shoulder bolts extending vertically from the surface plate, wherein the number of container alignment bores correspond to the number of the plurality of packing tubes.

3. The particulate material delivery and packing apparatus of claim 2 wherein the magazine subassembly further comprises a first set of a plurality of magazine springs, wherein each spring is positioned about one of the plurality of shoulder bolts, wherein the magazine subassembly further comprises a first alignment plate formed with a plurality of first plate through-bores dimensioned and aligned with the alignment bores and further formed with first plate bores each dimensioned to receive one of the plurality of shoulder bolts, wherein the first alignment plate is positioned over the plurality of shoulder bolts such that a bottom surface of the first alignment plate registers against top ends of the first set of the plurality of springs, wherein the magazine subassembly further comprises a second set of a plurality of magazine springs each positioned over a shoulder bolt so that a bottom end of each of the second set of the plurality of magazine springs registers against a top surface of the first alignment plate.

4. The particulate material delivery and packing apparatus of claim 3 wherein the magazine subassembly further comprises a second alignment plate secured over the shoulder bolts, wherein the second alignment plate is formed with a plurality of second alignment bores each dimensioned and aligned with the alignment bores of the surface plate, and wherein top ends of the plurality of second alignment bores are formed with chamfers.

5. The particulate material delivery and packing apparatus of claim 2 wherein the main mounting plate further comprises locator pins extending upwardly from a top surface of the main mounting plate, wherein the locator pins are dimensioned to fit within the locator bores of the surface plate.

6. The particulate material delivery and packing apparatus of claim 5 further comprising at least two load cells positioned on a top surface of the main mounting plate, wherein the at least two load cells register against a bottom surface of the magazine subassembly.

7. The particulate material delivery and packing apparatus of claim 1 wherein the extrusion tower further comprises a top tower plate secured to a top end of the extrusion tower.

8. The particulate material delivery and packing apparatus of claim 7 wherein the z-axis carriage further comprises a threaded nut, two guide-rail-receiving slots that each conform to the shape of the guide rails in cross section, two slide tracks each secured to opposing sides of the z-axis carriage, and a magnet assembly mounting plate secured to a top surface of the z-axis carriage, wherein the threaded nut engages the lead screw and secures the z-axis carriage to the lead screw, and wherein each of the two guide-rail-receiving slots registers about one of the two guide rails in sliding engagement.

9. The particulate material delivery and packing apparatus of claim 8 wherein the electromagnet vibration subassembly comprises an electromagnet secured to the magnet assembly mounting plate, and wherein the magnetic conductor comprises an angle iron having a first angle iron edge and a second angle-iron edge and a pair of vibration-decoupling springs, wherein the first angle iron edge is secured to first ends of the pair of vibration-decoupling springs, and wherein the z-axis carriage is secured to second ends of the pair of vibration-decoupling springs.

10. The particulate material delivery and packing apparatus of claim 9 further comprising a slide carriage having a top slide-carriage end, wherein the second angle iron edge is secured to the top slide-carriage end, and wherein the hopper assembly is secured to the slide carriage.

11. The particulate material delivery and packing apparatus of claim 10 wherein the slide carriage further comprises a pair of spaced slide wheel axles extending laterally from a back side of the slide carriage with a slide wheel secured to each of the pair of slide wheel axles, wherein the slide wheels rotate freely about the slide wheel axles, and wherein the slide wheels each register against and rotate along one of the two slide tracks.

12. The particulate material delivery and packing apparatus of claim 11 further comprising a pair of stand-off springs secured between the electromagnet and the magnetic conductor.

13. The particulate material delivery and packing apparatus of claim 12 further comprising a pair of chatter weights suspended from the magnetic conductor via bolts, wherein each of the pair of chatter weights is formed with a central through-bore to receive a bolt with the dimensions of the central through-bore set to permit free vertical translation of each of the pair of chatter weights along the bolts.

14. The particulate material delivery and packing apparatus of claim 13 wherein the hopper assembly comprises four walls sloped inwardly toward a bottom end of the hopper, wherein a plurality of tube bores are formed in the bottom end of the hopper, and wherein the hopper assembly further comprises a plurality of particulate delivery and packing tubes having leading edges, wherein each packing tube is secured within one of the plurality of tube bores, wherein each of the plurality of packing tubes is dimensioned in cross-section to fit within elongate containers positioned in the magazine subassembly.

15. The particulate material delivery and packing apparatus of claim 14 wherein each of the plurality of tube bores is formed with a counterbore.

16. The particulate material delivery and packing apparatus of claim 14 wherein top ends of the plurality of packing tubes extend above a bottom surface of the hopper assembly.

17. The particulate material delivery and packing apparatus of claim 1 further comprising proximity sensors secured to the main mounting plate.

18. The particulate material delivery and packing apparatus of claim 5 further comprising elastomeric cushions positioned about the locator pins.

* * * * *